US010381701B2

(12) United States Patent
Motoi

(10) Patent No.: US 10,381,701 B2
(45) Date of Patent: Aug. 13, 2019

(54) FILTER CIRCUIT AND FREQUENCY SWITCHING METHOD

(71) Applicant: NEC CORPORATION, Tokyo (JP)

(72) Inventor: Keiichi Motoi, Tokyo (JP)

(73) Assignee: NEC CORPORATION, Minato-ku, Tokyo (JP)

( * ) Notice: Subject to any disclaimer, the term of this patent is extended or adjusted under 35 U.S.C. 154(b) by 112 days.

(21) Appl. No.: 15/564,785

(22) PCT Filed: Apr. 8, 2016

(86) PCT No.: PCT/JP2016/061517
§ 371 (c)(1),
(2) Date: Oct. 6, 2017

(87) PCT Pub. No.: WO2016/167190
PCT Pub. Date: Oct. 20, 2016

(65) Prior Publication Data

US 2018/0115033 A1 Apr. 26, 2018

(30) Foreign Application Priority Data

Apr. 13, 2015 (JP) ..... 2015-081751

(51) Int. Cl.
*H01P 1/203* (2006.01)
*H01P 1/205* (2006.01)

(52) U.S. Cl.
CPC ..... *H01P 1/20327* (2013.01); *H01P 1/203* (2013.01); *H01P 1/205* (2013.01)

(58) Field of Classification Search
CPC ..... H01P 1/203; H01P 1/205; H01P 1/20327
USPC ..... 333/204, 205
See application file for complete search history.

(56) References Cited

U.S. PATENT DOCUMENTS 6,404,304 B1 * 6/2002 Kwon ..... H01P 1/20327 333/202

FOREIGN PATENT DOCUMENTS

| | | | |
|---|---|---|---|
| JP | 03-135211 | A | 6/1991 |
| JP | 09-270602 | A | 10/1997 |
| JP | 2001-119257 | A | 4/2001 |
| JP | 2015-015560 | A | 1/2015 |

OTHER PUBLICATIONS

International Search Report of PCT/JP2016/061517 dated Jun. 28, 2016 [PCT/ISA/210].
Written Opinion of PCT/JP2016/061517 dated Jun. 28, 2016 [PCT/ISA/237].

* cited by examiner

*Primary Examiner* — Rakesh B Patel
(74) *Attorney, Agent, or Firm* — Sughrue Mion, PLLC

(57) ABSTRACT

A first switch is configured to open and close connection between an end part of a first transmission line and ground, and a second switch is configured to open and close connection between an end part of a third transmission line and ground.

20 Claims, 16 Drawing Sheets

FILTER CIRCUIT AND FREQUENCY SWITCHING METHOD

CROSS REFERENCE TO RELATED APPLICATIONS

This application is a National Stage of International Application No. PCT/JP2016/061517, filed Apr. 8, 2016, claiming priority based on Japanese Patent Application No. 2015-081751, filed Apr. 13, 2015, the contents of all of which are incorporated herein by reference in their entirety.

TECHNICAL FIELD

The present invention relates to a filter circuit that passes a high-frequency electrical signal, and a frequency switching method.

BACKGROUND

In recent years, frequency bands used in a mobile network have increased along with rapid increase in mobile traffic. Thus, a filter circuit that is equipped in a communication device for selecting and suppressing transmission and reception signals is desired to support a plurality of frequency bands. As a bandpass filter supporting a plurality of frequency bands, a filter that includes a transmission line such as a microstrip line formed on a plane circuit is known. For example, PTL 1 describes a bandpass filter capable of selecting either a mode of a dual-band bandpass filter or a mode of a single-band bandpass filter, by selecting whether a half-wavelength resonator and a one-side short-circuited resonator are connected by a changeover switch or are not connected.

CITATION LIST

Patent Literature

[PTL 1] Japanese Unexamined Patent Application Publication No. 2015-15560

SUMMARY OF INVENTION

Technical Problem

However, the bandpass filter described in PTL 1, when being switched into the dual-band bandpass filter, passes signals of a plurality of frequency bands at the same time. This results in passing not only a desired signal, but also an unnecessary wave included outside the band. In addition, the bandpass filter described in PTL 1 is unable to selectively switch a center frequency of the single-band bandpass filter into different frequencies.

An example of an object of the present invention is to provide a filter circuit and a frequency switching method that solve the problem described above.

Solution to Problem

A filter circuit according to a first aspect of the present invention includes: a first transmission line that has an electrical length being a one-quarter length of a first wavelength, and includes a first end part and a second end part positioned on opposite sides to each other with respect to a direction in which electricity flows through the first transmission line; a second transmission line that has an electrical length being a one-quarter length of the first wavelength, is spaced apart from and faces the first transmission line, and includes a first opposing part opposing the first end part of the first transmission line and a second opposing part opposing the second end part of the first transmission line; an input terminal that is connected with the first end part or the second end part of the first transmission line; a third transmission line that has an electrical length being a one-quarter length of the first wavelength, and includes a first end part and a second end part positioned on opposite sides to each other with respect to a direction in which electricity flows through the third transmission line; a fourth transmission line that has an electrical length being a one-quarter length of the first wavelength, is spaced apart from and faces the third transmission line, and includes a first opposing part opposing the first end part of the third transmission line and a second opposing part opposing the second end part of the third transmission line; an output terminal that is connected with the first end part or the second end part of the third transmission line; a first open end part that is connected with the first opposing part of the second transmission line, and has a predetermined electrical length; a second open end part that is connected with the first opposing part of the fourth transmission line, and has a predetermined electrical length; a fifth transmission line that includes a first end part and a second end part positioned on opposite sides to each other with respect to a direction in which electricity flows through the fifth transmission line, the first end part of the fifth transmission line being connected with the second opposing part of the second transmission line; a sixth transmission line that includes a first end part and a second end part positioned on opposite sides to each other with respect to a direction in which electricity flows through the sixth transmission line, and a portion that is spaced apart from and faces at least a part of the fifth transmission line, the first end part of the sixth transmission line being connected with the second opposing part of the fourth transmission line; a first switch that is configured to open and close connection between the first end part of the first transmission line and ground; and a second switch that is configured to open and close connection between the first end part of the third transmission line and ground. Each of a transmission line composed of the first open end part, the second transmission line, and the fifth transmission line, and a transmission line composed of the second open end part, the third transmission line, and the sixth transmission line, has an electrical length being a one-quarter length of a second wavelength that is a longer wavelength than the first wavelength. The second end part of the fifth transmission line and the second end part of the sixth transmission line are connected with ground.

A filter circuit according to a second aspect of the present invention includes: a first transmission line that has an electrical length being a one-quarter length of a first wavelength, and includes a first end part and a second end part positioned on opposite sides to each other with respect to a direction in which electricity flows through the first transmission line; a second transmission line that has an electrical length being a one-quarter length of the first wavelength, is spaced apart from and faces the first transmission line, and includes a first opposing part opposing the first end part of the first transmission line and a second opposing part opposing the second end part of the first transmission line; an input terminal that is connected with the first end part or the second end part of the first transmission line; a third transmission line that has an electrical length being a one-quarter length of the first wavelength, and includes a first end part and a second end part positioned on opposite sides to each other with respect to a direction in which electricity flows through the third transmission line; a fourth transmission line that has an electrical length being a one-quarter length of the first wavelength, is spaced apart from and faces the third transmission line, and includes a first opposing part opposing the first end part of the third transmission line and a second opposing part opposing the second end part of the third transmission line; an output terminal that is connected with the first end part or the second end part of the third transmission line; a first open end part that is connected with the first opposing part of the second transmission line, and has a predetermined electrical length; a second open end part that is connected with the first opposing part of the fourth transmission line, and has a predetermined electrical length; a fifth transmission line that includes a first end part and a second end part positioned on opposite sides to each other with respect to a direction in which electricity flows through the fifth transmission line, the first end part of the fifth transmission line being connected with the second opposing part of the second transmission line; a sixth transmission line that includes a first end part and a second end part positioned on opposite sides to each other with respect to a direction in which electricity flows through the sixth transmission line, and a portion that is spaced apart from and faces at least a part of the fifth transmission line, the first end part of the sixth transmission line being connected with the second opposing part of the fourth transmission line; an inductor that is connected between the second end part of the fifth transmission line and the second end part of the sixth transmission line; a third switch that is configured to open and close connection between the second end part of the fifth transmission line and ground; and a fourth switch that is configured to open and close connection between the second end part of the sixth transmission line and ground. Each of a transmission line composed of the first open end part, the second transmission line, and the fifth transmission line, and a transmission line composed of the second open end part, the fourth transmission line, and the sixth transmission line, has an electrical length being a one-quarter length of a second wavelength that is a longer wavelength than the first wavelength. The first end part of the first transmission line and the first end part of the third transmission line are opened.

A frequency switching method according to a third aspect of the present invention is a frequency switching method for the above-described filter circuit, and includes: opening the first switch and the second switch; and closing the first switch and the second switch.

A frequency switching method according to a fourth aspect of the present invention is a frequency switching method for the above-described filter circuit, and includes: opening the third switch and the fourth switch; and closing the third switch and the fourth switch.

Advantageous Effects of Invention

According to at least one aspect among the above-described aspects, a center frequency of a filter circuit can be selectively switched into different frequencies, by switching opening and closing of a first switch and a second switch, or a third switch and a fourth switch of the filter circuit.

DESCRIPTION OF EMBODIMENTS

First Example Embodiment

Hereinafter, example embodiments will be described in detail with reference to the drawings.

Figure 1:
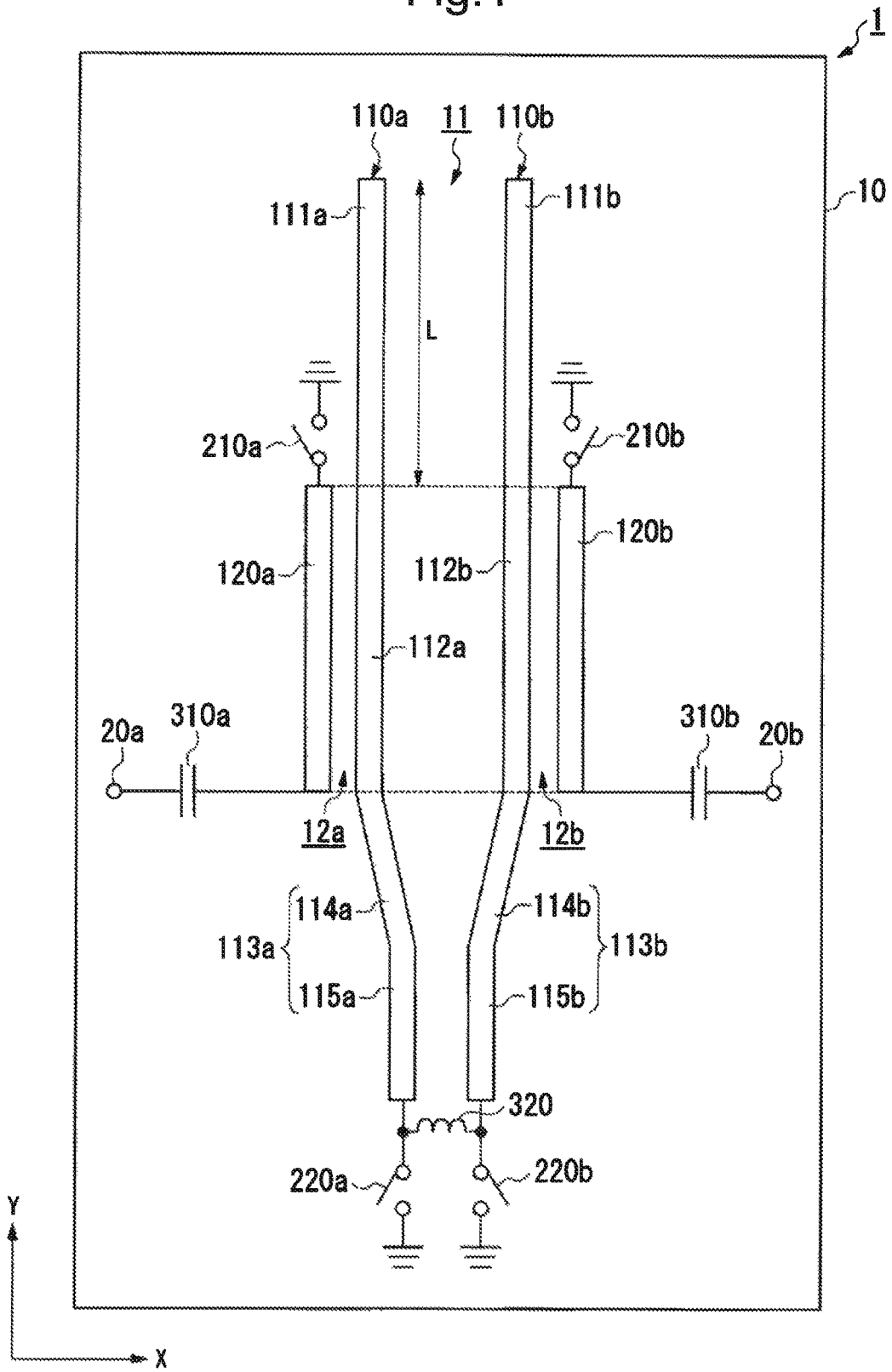
FIG. 1 is a diagram illustrating a configuration of a filter circuit according to a first example embodiment.

FIG. 1 is a diagram illustrating a configuration of a filter circuit according to a first example embodiment.

A filter circuit 1 according to the present example embodiment is able to selectively switch a center frequency of a passband into three frequency bands, which are a first frequency f1, a second frequency f2, and a third frequency f3. The second frequency f2 is a frequency being twice the first frequency f1. The third frequency f3 is a frequency being three times the first frequency f1. Herein, "a frequency being n times a frequency f" is not limited to a frequency that is exactly n times a frequency f, but also includes a frequency around the frequency that is exactly n times the frequency f.

The filter circuit 1 is constituted by a microstrip line circuit. In other words, the filter circuit 1 is implemented by forming a transmission line, by using a conductive foil, on a front face of a dielectric substrate 10 on a rear face of which the conductive foil is formed. Specifically, four transmission lines, which are a first main transmission line 110*a*, a second main transmission line 110*b*, a first subordinate transmission line 120*a*, and a second subordinate transmission line 120*b*, are formed on the front face of the dielectric substrate 10. All of the first main transmission line 110*a*, the second main transmission line 110*b*, the first subordinate transmission line 120*a*, and the second subordinate transmission line 120*b* are transmission lines extending in a Y-axis direction as a whole. In the present example embodiment, electric current flows in a longitudinal direction of the first main transmission line 110*a*, the second main transmission line 110*b*, the first subordinate transmission line 120*a*, and the second subordinate transmission line 120*b*. In other words, in the present example embodiment, a direction in which electric current flows is the Y-axis direction.

The first main transmission line 110*a*, the second main transmission line 110*b*, the first subordinate transmission line 120*a*, and the second subordinate transmission line 120*b* are arranged side by side in an X-axis direction that is a direction orthogonal to a Y axis.

Both of the first main transmission line 110*a* and the second main transmission line 110*b* have an electrical length being one quarter a wavelength equivalent to the first frequency f1. The wavelength equivalent to the first frequency f1 is an example of a second wavelength.

Both of the first subordinate transmission line 120*a* and the second subordinate transmission line 120*b* have an electrical length being one quarter a wavelength equivalent to the third frequency f3. In other words, the first subordinate transmission line 120*a* and the second subordinate transmission line 120*b* have an electrical length being one twelfth a wavelength equivalent to the first frequency f1. The wavelength equivalent to the third frequency f3 is an example of a first wavelength.

Herein, "an electrical length being one quarter a wavelength" is not limited to an electrical length being exactly one quarter a wavelength, but also includes an electrical length that is shorter or longer than one quarter the wavelength and that is excited by a signal having the wavelength. For example, when the third frequency f3 is 4 GHz and a dielectric constant of the dielectric substrate 10 is 3.5, an electrical length being one quarter a wavelength equivalent to the third frequency f3 includes not only 12 mm, but also a range around 12 mm, such as 11 mm and 13 mm.

The first main transmission line 110*a* and the second main transmission line 110*b* are arranged in such a way as to partially face each other with a space therebetween. The first subordinate transmission line 120*a* is arranged in such a way as to face a part of the first main transmission line 110*a* with a space therebetween. The second subordinate transmission line 120*b* is arranged in such a way as to face a part of the second main transmission line 110*b* with a space therebetween.

The first main transmission line 110*a* is constituted of three partial transmission lines, which are a first open stub 111*a*, a first subordinate coupling part 112*a*, and a first main coupling part 113*a*, in order from a first side (upper side of the drawing) in the Y-axis direction. Likewise, the second main transmission line 110*b* is constituted of three partial transmission lines, which are a second open stub 111*b*, a second subordinate coupling part 112*b*, and a second main coupling part 113*b*, in order from the first side in the Y-axis direction.

The first open stub 111*a* and the second open stub 111*b* are partial transmission lines, each functioning as an open stub having an electrical length L. In other words, first-side ends in the Y-axis direction of the first open stub 111*a* and the second open stub 111*b* are opened. The electrical length is an electrical length standardized with a wavelength of a signal flowing inside a transmission line. For example, when an electrical length of a certain transmission line is $\lambda/4$, a maximum amplitude of a signal having a wavelength $\lambda$ is achieved at a first end of the transmission line while a minimum amplitude of the signal is achieved at a second end of the transmission line. At this time, a physical length of the transmission line is not necessarily limited to $\lambda/4$.

The first subordinate coupling part 112*a* and the second subordinate coupling part 112*b* are partial transmission lines respectively facing the first subordinate transmission line 120*a* and the second subordinate transmission line 120*b* with a space therebetween. Accordingly, the first subordinate coupling part 112*a* and the first subordinate transmission line 120*a* function as a first subordinate coupling line 12*a*. In addition, the second subordinate coupling part 112*b* and the second subordinate transmission line 120*b* function as a second subordinate coupling line 12*b*.

The first main coupling part 113*a* and the second main coupling part 113*b* are arranged in such a way as to partially face each other with a space therebetween. Specifically, the first main coupling part 113*a* and the second main coupling part 113*b* are arranged in such a way that a first coupling part 115*a* formed on a second side (lower side of the drawing) in the Y-axis direction of the first main coupling part 113*a*, and a second coupling part 115*b* formed on the second side in the Y-axis direction of the second main coupling part 113*b*, face each other with a space therebetween. A first connecting part 114*a* formed on the first side in the Y-axis direction of the first main coupling part 113*a* connects the first subordinate coupling part 112*a* with the first coupling part 115*a*. Likewise, a second connecting part 114*b* formed on the first side in the Y-axis direction of the second main coupling part 113*b* connects the second subordinate coupling part 112*b* with the second coupling part 115*b*.

In other words, the first open stub 111*a* is connected with a position of the first subordinate coupling part 112*a*, opposing a first-side end part in the Y-axis direction of the first subordinate transmission line 120*a*. In addition, the second open stub 111*b* is connected with a position of the second subordinate coupling part 112*b*, opposing a first-side end part in the Y-axis direction of the second subordinate transmission line 120*b*.

In addition, the first main coupling part 113*a* is connected with a position of the first subordinate coupling part 112*a*, opposing a second-side end part in the Y-axis direction of the first subordinate transmission line 120*a*. In addition, the second main coupling part 113*b* is connected with a position of the second subordinate coupling part 112*b*, opposing a second-side end part in the Y-axis direction of the second subordinate transmission line 120*b*.

A first switch 210*a* and a second switch 210*b* that enable opening and closing of connection with ground are respectively provided on first-side ends in the Y-axis direction of the first subordinate transmission line 120*a* and the second subordinate transmission line 120*b*. Switching opening and closing of the first switch 210*a* and the second switch 210*b* allows for switching whether to make each of the first subordinate transmission line 120*a* and the second subordinate transmission line 120*b* function as an open stub or a short stub.

An input terminal 20*a* is connected with a second-side end in the Y-axis direction of the first subordinate transmission line 120*a* through a first capacitor 310*a*. An output terminal 20*b* is connected with a second-side end in the Y-axis direction of the second subordinate transmission line 120*b* through a second capacitor 310*b*. Accordingly, the first capacitor 310*a* and the second capacitor 310*b* cut off a direct current component from a signal input to the filter circuit 1, and match input and output impedance of the filter circuit 1.

A second-side end in the Y-axis direction of the first main transmission line 110*a* is connected with a second-side end in the Y-axis direction of the second main transmission line 110*b* through an inductor 320. The inductor 320 corrects a coupling constant of electromagnetic coupling between the first coupling part 115*a* and the second coupling part 115*b*, when the first main transmission line 110*a* and the second main transmission line 110*b* are excited with an odd mode.

A third switch 220*a* and a fourth switch 220*b* that enable opening and closing of connection with ground are respectively provided on the second-side ends in the Y-axis direction of the first main transmission line 110*a* and the second main transmission line 110*b*. A main coupling line 11 is composed of the first main transmission line 110*a* and the second main transmission line 110*b*. Switching opening and closing of the third switch 220*a* and the fourth switch 220*b* allows for switching whether to make the main coupling line 11 function as a both-sides-open half-wavelength resonator or a one-side-open coupling line pair.

A behavior of the filter circuit 1 according to the present example embodiment will be described.

First, a case in which the filter circuit 1 is made to function as a filter that passes a first frequency will be described.

Figure 2:
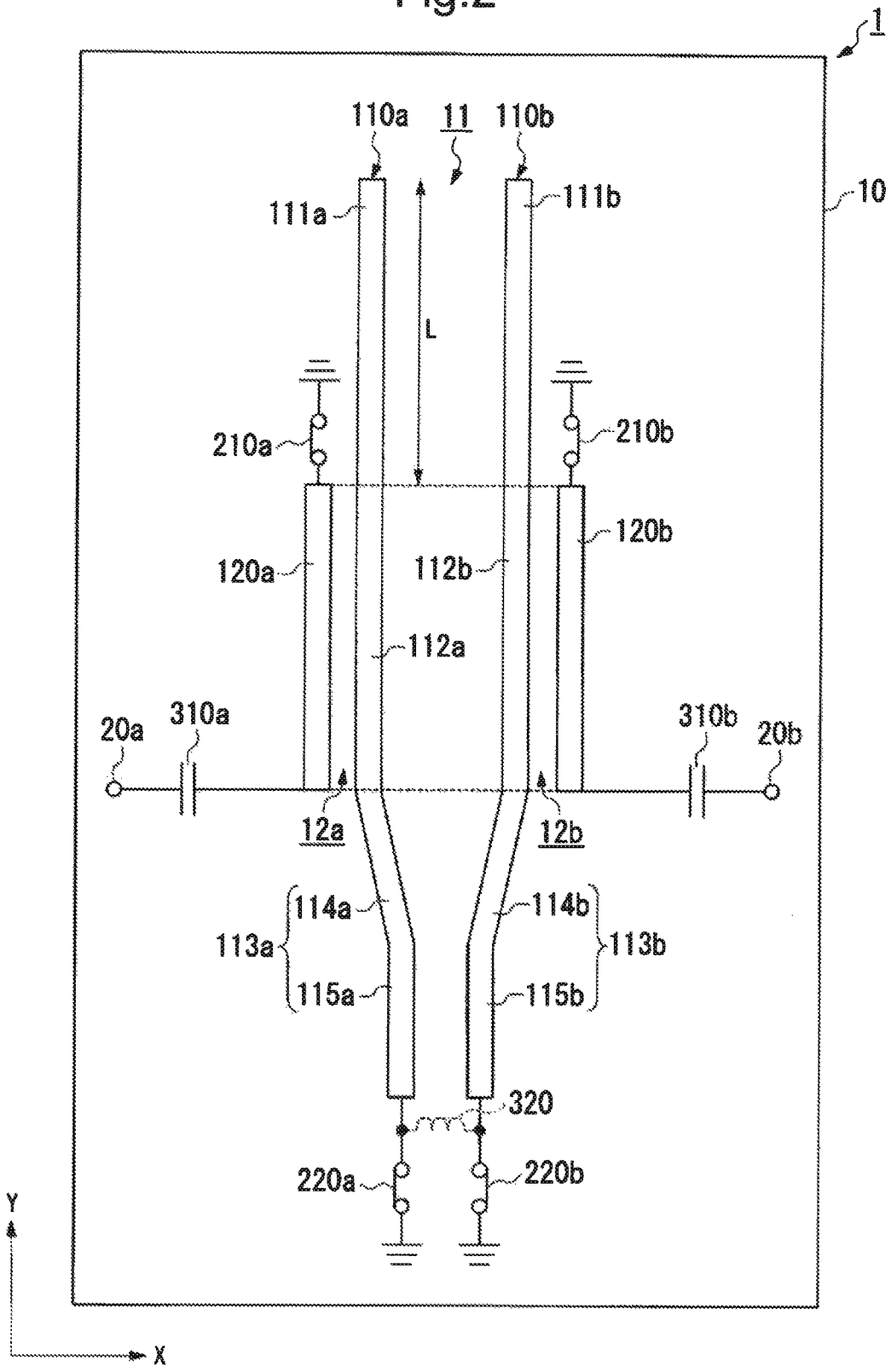
FIG. 2 is a diagram illustrating a circuit configuration when the filter circuit according to the first example embodiment is made to function as a filter that passes a first frequency.

FIG. 2 is a diagram illustrating a circuit configuration when the filter circuit according to the first example embodiment is made to function as a filter that passes a first frequency.

When the filter circuit 1 is made to function as a filter that passes a first frequency, the first switch 210*a* and the second switch 210*b*, and the third switch 220*a* and the fourth switch 220*b* are closed.

When an electrical signal is applied to the input terminal 20*a*, a direct current component of the signal is cut off by the first capacitor 310*a*. A signal from which a direct current component is cut off flows into the first subordinate transmission line 120*a*. When the signal flows into the first subordinate transmission line 120*a*, the signal is transmitted, by electromagnetic coupling, to the first subordinate coupling part 112*a* that is electromagnetically coupled with the first subordinate transmission line 120*a*. Since the third switch 220*a* and the fourth switch 220*b* are closed, the main coupling line 11 including the first subordinate coupling part 112*a* functions as a one-side-open transmission line that has an electrical length being one quarter a wavelength corresponding to the first frequency. In other words, the main coupling line 11 functions as a bandpass filter that passes an odd-times higher harmonic having the first frequency.

Upon occurrence of a signal in the main coupling line 11, the signal is transmitted to the second subordinate transmission line 120*b* that is electromagnetically coupled with the second subordinate coupling part 112*b*. Accordingly, a first-frequency signal out of input signals is output from the output terminal 20*b* connected with the second subordinate transmission line 120*b*.

The main coupling line 11 may also satisfy a matching condition for a signal having a third frequency that is a frequency being three times the first frequency. On the other hand, a degree of coupling between the first subordinate transmission line 120*a* and the first subordinate coupling part 112*a* is adjusted by setting an appropriate electrical length for an electrical length L of the first open stub 111*a* of the main coupling line 11, which enables suppression of resonance of a third-frequency signal.

Figure 3:
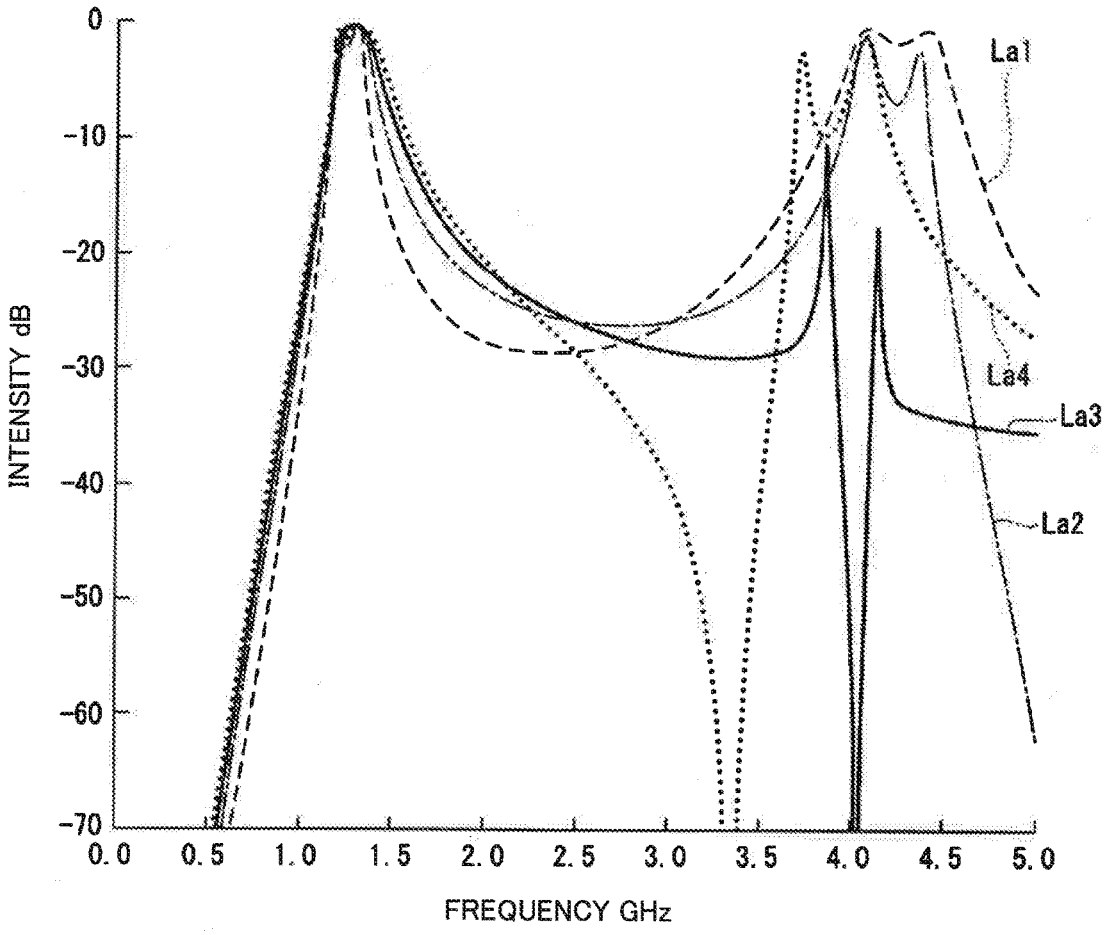
FIG. 3 is a diagram illustrating a relationship between an electrical length of an open stub of a main coupling line and a frequency component included in an output signal, when the filter circuit according to the first example embodiment is made to function as a filter that passes a first frequency.

FIG. 3 is a diagram illustrating a relationship between an electrical length of an open stub of a main coupling line and a frequency component included in an output signal, when the filter circuit according to the first example embodiment is made to function as a filter that passes a first frequency. In the present example, it is assumed that a first frequency is 1.3 GHz, a second frequency is 2.7 GHz, and a third frequency is 4 GHz. In addition, in the present example, it is assumed that a dielectric constant of the dielectric substrate 10 is 3.5. In FIG. 3, a line La1 indicates a case in which the first open stub 111*a* and the second open stub 111*b* have an electrical length L of 2 mm. A line La2 indicates a case in which the electrical length L is 8 mm. A line La3 indicates a case in which the electrical length L is 12 mm. A line La4 indicates a case in which the electrical length L is 14 mm. As illustrated in FIG. 3, as the electrical length L of the first open stub 111*a* and the second open stub 111*b* becomes closer to one quarter (12 mm) a wavelength corresponding to the third frequency, a frequency that achieves a minimum signal intensity appearing around the third frequency becomes closer to the third frequency, and a minimum value of the signal intensity appearing around the third frequency becomes smaller. From this relationship, the first open stub 111*a* and the second open stub 111*b* are allowed to function as open end parts that suppress a third-frequency signal, by setting the electrical length L of the first open stub 111*a* and the second open stub 111*b* to be one quarter a wavelength corresponding to the third frequency.

In this way, the present example embodiment enables the filter circuit 1 to function as a filter that passes a first frequency, by closing the first switch 210*a* and the second switch 210*b*, and the third switch 220*a* and the fourth switch 220*b*.

An example of a case will be described in which a line length of the first subordinate coupling line 12*a* and the second subordinate coupling line 12*b* is set to a value other than one quarter a wavelength of a third frequency.

Figure 4:
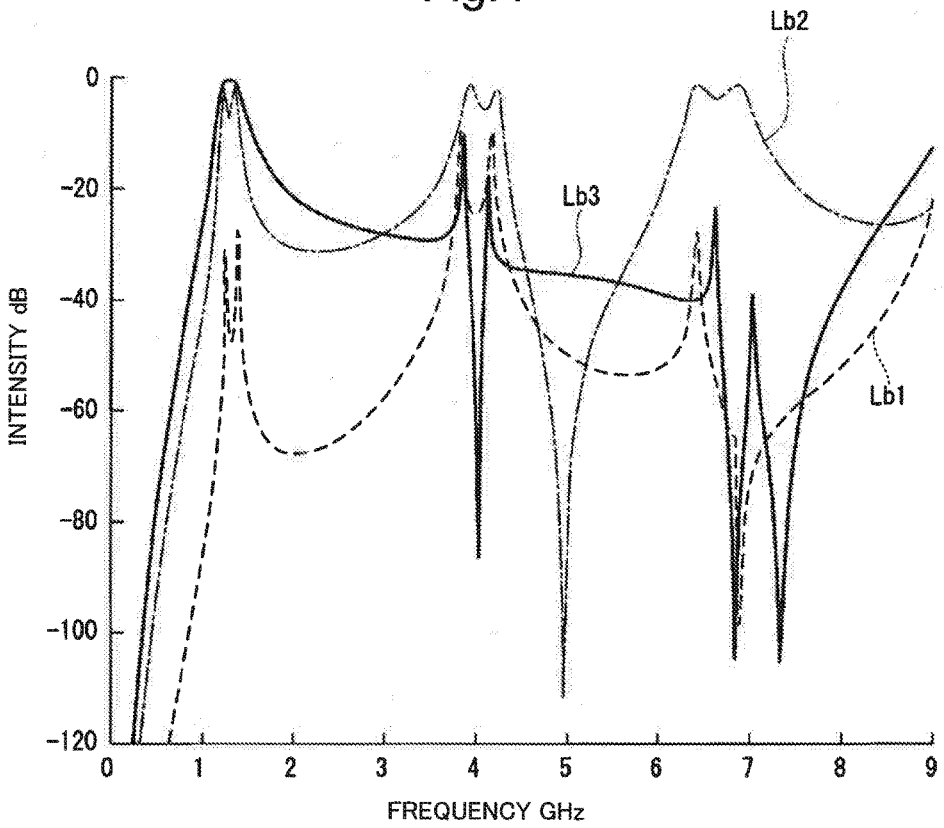
FIG. 4 is a first diagram illustrating a relationship between an electrical length of a subordinate coupling line and a frequency component included in an output signal, according to the first example embodiment.

FIG. 4 is a first diagram illustrating a relationship between an electrical length of a subordinate coupling line and a frequency component included in an output signal. In the present example, a frequency characteristic is indicated, in a case of assuming that an electrical length L of the first open stub 111*a* and the second open stub 111*b* is one quarter a wavelength corresponding to a third frequency, and varying a line length of the first subordinate coupling line 12*a* and the second subordinate coupling line 12*b*. In FIG. 3, a line Lb1 indicates a case in which the first subordinate coupling line 12*a* and the second subordinate coupling line 12*b* have a line length of 1 mm. A line Lb2 indicates a case in which the line length is 7 mm. A line Lb3 indicates a case in which the line length is 13 mm.

As illustrated in FIG. 4, as the line length of the first subordinate coupling line 12*a* and the second subordinate coupling line 12*b* becomes closer to one quarter a wavelength corresponding to the third frequency, a signal intensity of the first frequency becomes larger. In addition, when the line length of the first subordinate coupling line 12*a* and the second subordinate coupling line 12*b* is close to one quarter a wavelength corresponding to the third frequency, a high-order harmonic having the first frequency is suppressed. In other words, the filter circuit 1 is allowed to appropriately function as a filter that passes the first frequency, by setting the line length of the first subordinate coupling line 12*a* and the second subordinate coupling line 12*b* to be one quarter a wavelength of the third frequency (one twelfth a wavelength of the first frequency).

Figure 5:
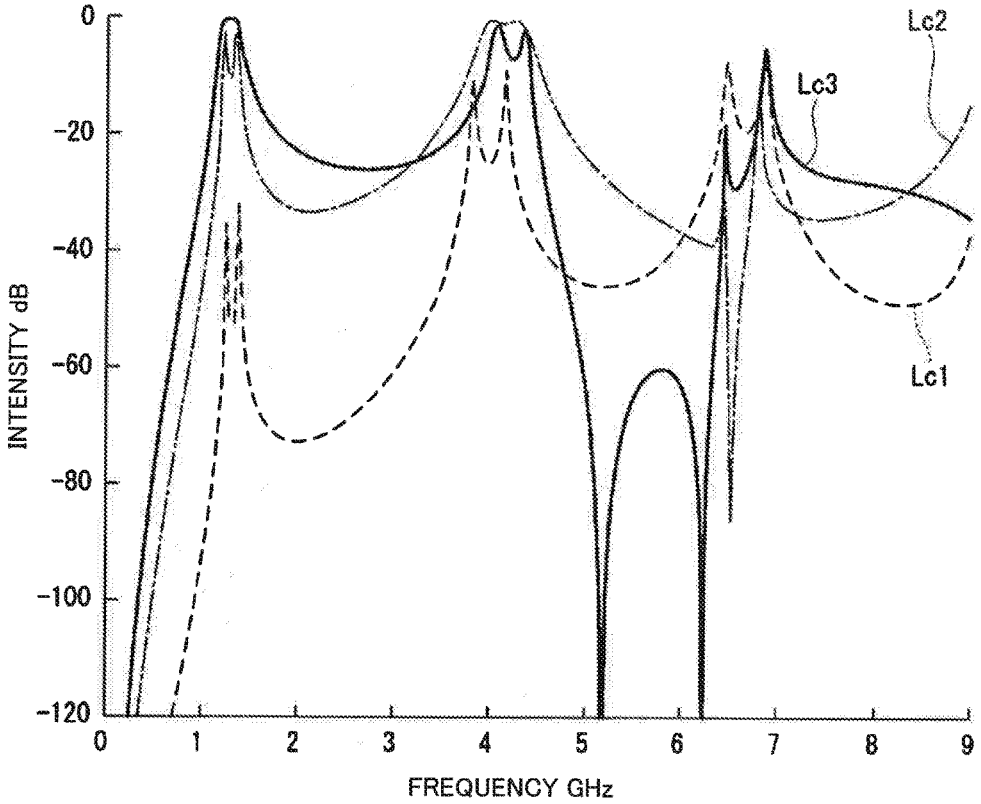
FIG. 5 is a second diagram illustrating a relationship between an electrical length of a subordinate coupling line and a frequency component included in an output signal, according to the first example embodiment.

FIG. 5 is a second diagram illustrating a relationship between an electrical length of a subordinate coupling line and a frequency component included in an output signal. In the present example, a frequency characteristic is indicated, in a case of assuming that an electrical length L of the first open stub 111*a* and the second open stub 111*b* is an electrical length (8 mm) that is shorter than one quarter a wavelength corresponding to a third frequency, and varying a line length of the first subordinate coupling line 12*a* and the second subordinate coupling line 12*b*. In FIG. 3, a line Lc1 indicates a case in which the first subordinate coupling line 12*a* and the second subordinate coupling line 12*b* have a line length of 1 mm. A line Lc2 indicates a case in which the line length is 7 mm. A line Lc3 indicates a case in which the line length is 13 mm.

As illustrated in FIG. 5, when the electrical length L of the first open stub 111*a* and the second open stub 111*b* is set to be shorter than one quarter a wavelength corresponding to the third frequency, a high-order harmonic having the first frequency cannot be suppressed even when the line length of the first subordinate coupling line 12*a* and the second subordinate coupling line 12*b* is varied. In other words, the filter circuit 1 is allowed to more appropriately function as a filter that passes the first frequency, by setting the line length of the first subordinate coupling line 12*a* and the second subordinate coupling line 12*b* to be one quarter a wavelength of the third frequency, and setting the electrical length L of the first open stub 111*a* and the second open stub 111*b* to be one quarter a wavelength corresponding to the third frequency.

Next, a case in which the filter circuit 1 is made to function as a filter that passes a second frequency will be described.

Figure 6:
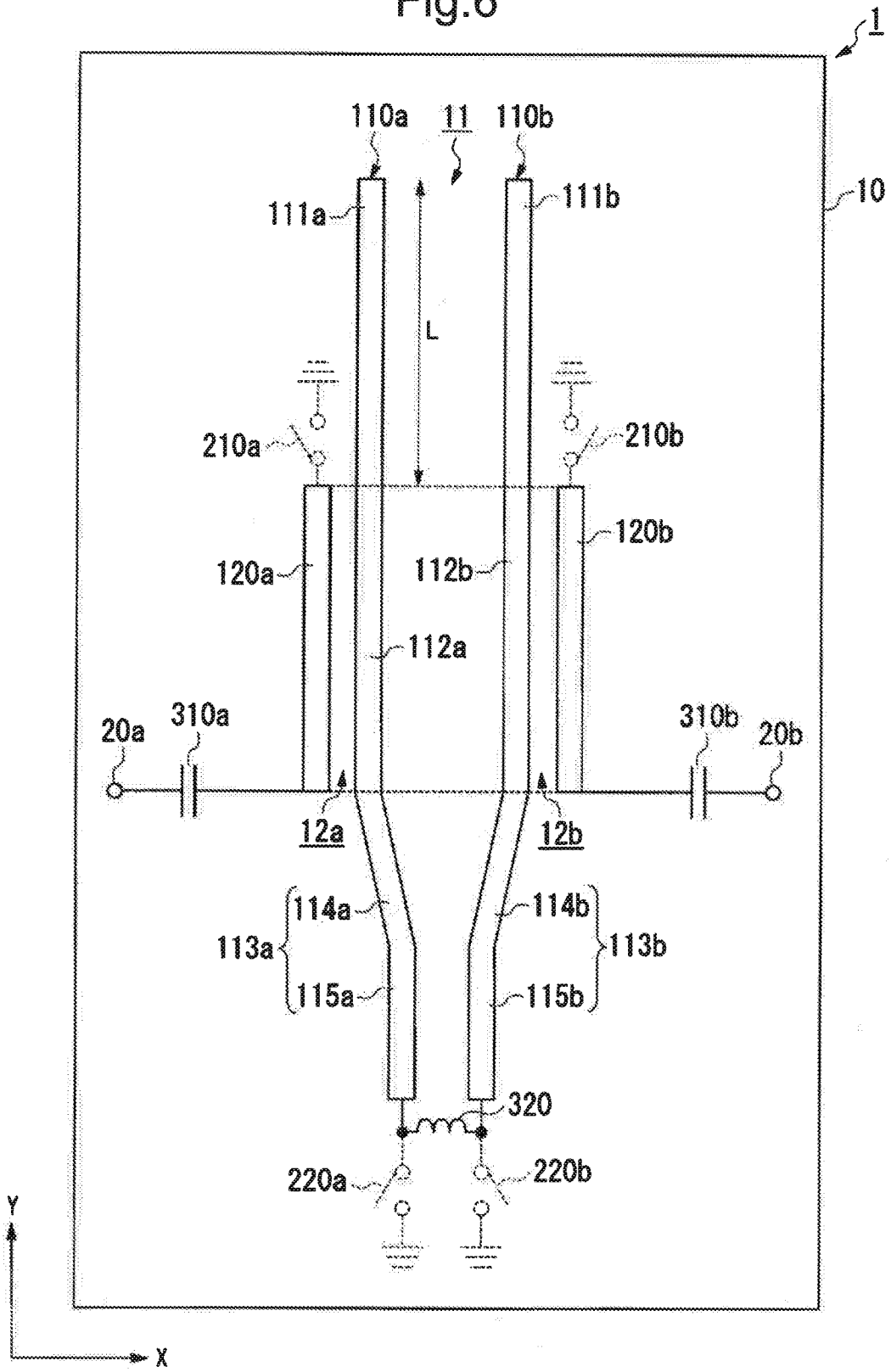
FIG. 6 is a diagram illustrating a circuit configuration when the filter circuit according to the first example embodiment is made to function as a filter that passes a second frequency.

FIG. 6 is a diagram illustrating a circuit configuration when the filter circuit according to the first example embodiment is made to function as a filter that passes a second frequency.

When the filter circuit 1 is made to function as a filter that passes a second frequency, the first switch 210*a* and the second switch 210*b*, and the third switch 220*a* and the fourth switch 220*b* are opened.

When an electrical signal is applied to the input terminal 20*a*, a direct current component of the signal is cut off by the first capacitor 310*a*. A signal from which a direct current component is cut off flows into the first subordinate transmission line 120*a*. When the signal flows into the first subordinate transmission line 120*a*, the signal is transmitted to the first subordinate coupling part 112*a* that is electromagnetically coupled with the first subordinate transmission line 120*a*. Since the third switch 220*a* and the fourth switch 220*b* are opened, the main coupling line 11 including the first subordinate coupling part 112*a* functions as a both-sides-open half-wavelength resonator that has an electrical length being one half a wavelength corresponding to the first frequency. In other words, the main coupling line 11 functions as a bandpass filter that passes a signal having a second frequency that is a frequency being twice the first frequency. Accordingly, the first main transmission line 110*a* and the second main transmission line 110*b* are excited with an odd mode. At this time, a coupling constant of electromagnetic coupling between the first coupling part 115*a* and the second coupling part 115*b* is corrected by the inductor 320.

Upon occurrence of a signal in the main coupling line 11, the signal is transmitted to the second subordinate transmission line 120*b* that is electromagnetically coupled with the second subordinate coupling part 112*b*. Accordingly, a second-frequency signal out of input signals is output from the output terminal 20*b* connected with the second subordinate transmission line 120*b*.

Figure 7:
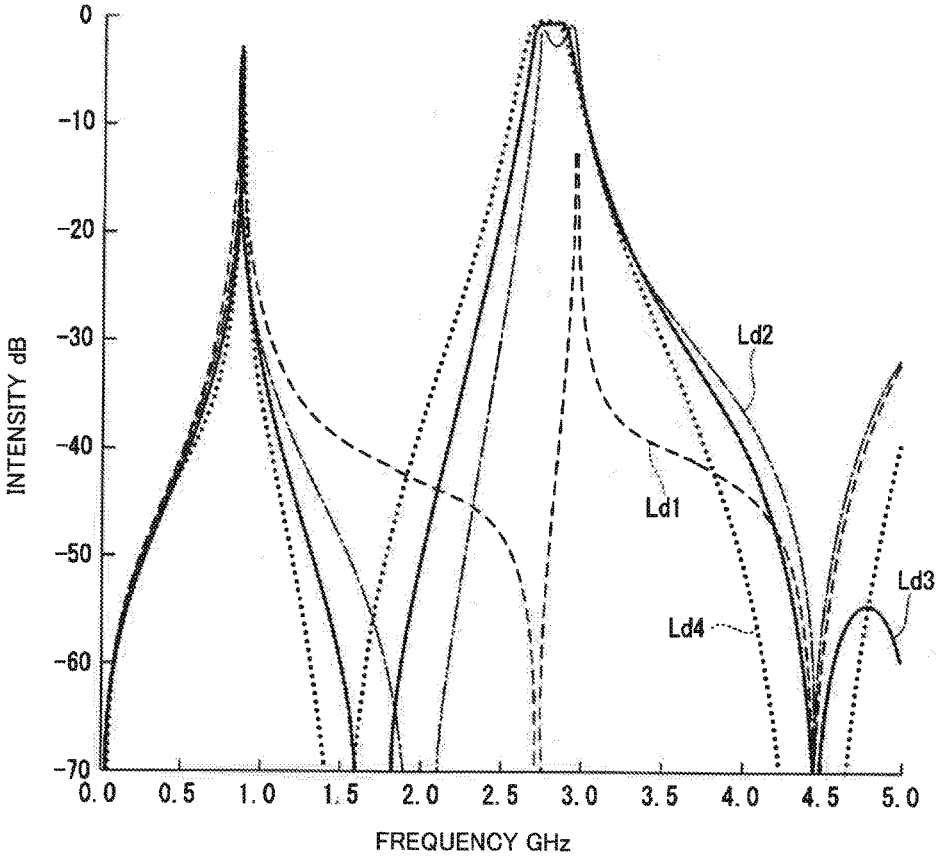
FIG. 7 is a diagram illustrating a relationship between an electrical length of an open stub of a main coupling line and a frequency component included in an output signal, when the filter circuit according to the first example embodiment is made to function as a filter that passes a second frequency.

FIG. 7 is a diagram illustrating a relationship between an electrical length of an open stub of a main coupling line and a frequency component included in an output signal, when the filter circuit according to the first example embodiment is made to function as a filter that passes a second frequency. In FIG. 7, a line Ld1 indicates a case in which the first open stub 111*a* and the second open stub 111*b* have an electrical length L of 2 mm. A line Ld2 indicates a case in which the electrical length L is 8 mm. A line Ld3 indicates a case in which the electrical length L is 12 mm. A line Ld4 indicates a case in which the electrical length L is 14 mm.

As illustrated in FIG. 7, as the electrical length L of the first open stub 111*a* and the second open stub 111*b* becomes closer to one quarter (12 mm) of the third frequency, a degree of matching between input and output of the first subordinate coupling line 12*a* and the second subordinate coupling line 12*b* increases. In other words, the closer the electrical length L of the first open stub 111*a* and the second open stub 111*b* is to one quarter of the third frequency, the higher a frequency characteristics with respect to the second frequency can be in the filter circuit 1.

In this way, the present example embodiment enables the filter circuit 1 to function as a filter that passes a second frequency, by opening the first switch 210*a* and the second switch 210*b*, and the third switch 220*a* and the fourth switch 220*b*.

Herein, the inductor 320 will be described.

Figure 8:
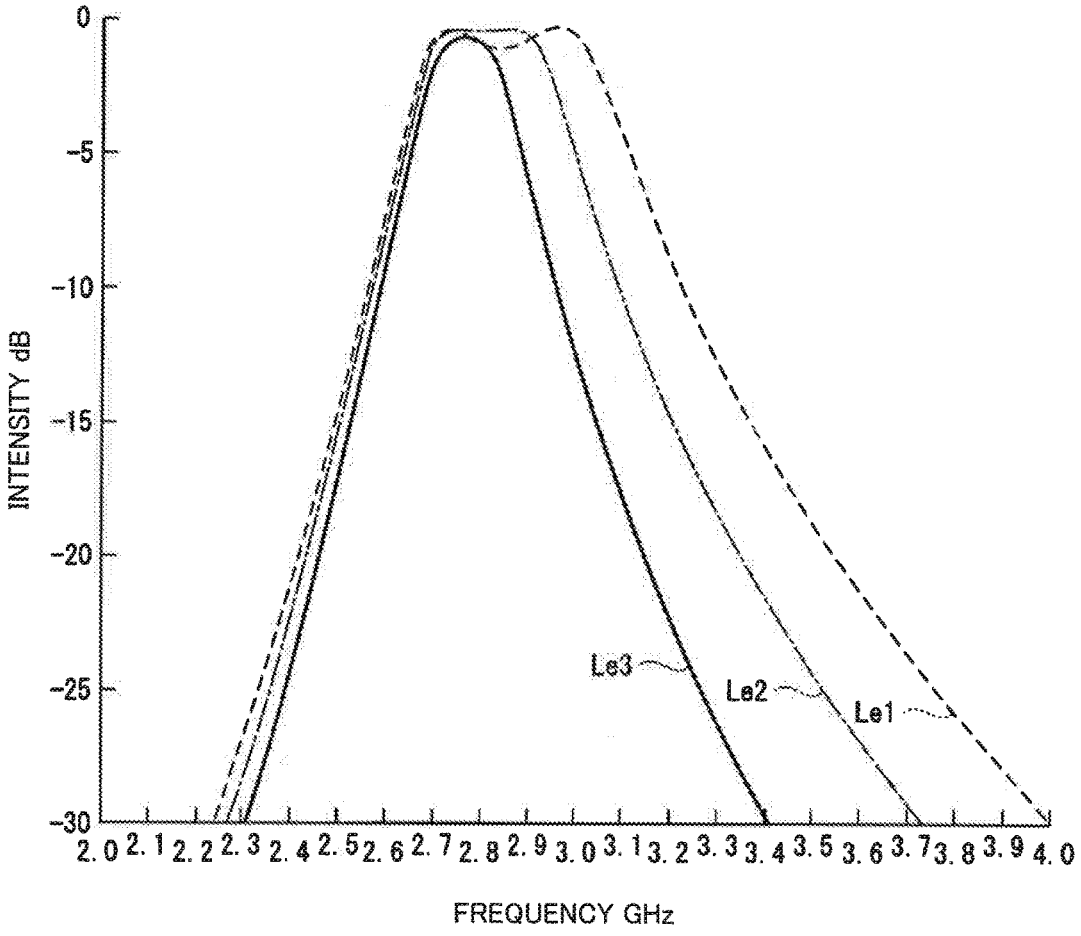
FIG. 8 is a diagram illustrating a relationship between an inter-main coupling line inductance and a frequency component included in an output signal, when the filter circuit according to the first example embodiment is made to function as a filter that passes a second frequency.

FIG. 8 is a diagram illustrating a relationship between an inter-main coupling line inductance and a frequency component included in an output signal, when the filter circuit according to the first example embodiment is made to function as a filter that passes a second frequency. In FIG. 8, a line Le1 indicates a case in which the inductor 320 has an inductance of 7 nH. A line Le2 indicates a case in which the inductor 320 has an inductance of 9 nH. A line Le1 indicates a case in which the inductor 320 has an inductance of 7 nH.

As illustrated in FIG. 8, a bandwidth that can be passed by the filter circuit 1 varies with change in the inductance of the inductor 320. Specifically, the higher the inductance of the inductor 320 is, the narrower the bandwidth is. When the third switch 220*a* and the fourth switch 220*b* are closed, the inductor 320 has no influence on an inter-main coupling line 11 inductance. In other words, the inductance of the inductor 320 has no influence on a circuit characteristic in a case of making the filter circuit 1 function as a filter that passes a first frequency and a case of making the filter circuit 1 function as a filter that passes a third frequency. In other words, the inductor 320 contributes to a degree of freedom in designing the filter circuit 1.

Next, a case in which the filter circuit 1 is made to function as a filter that passes a third frequency will be described.

Figure 9:
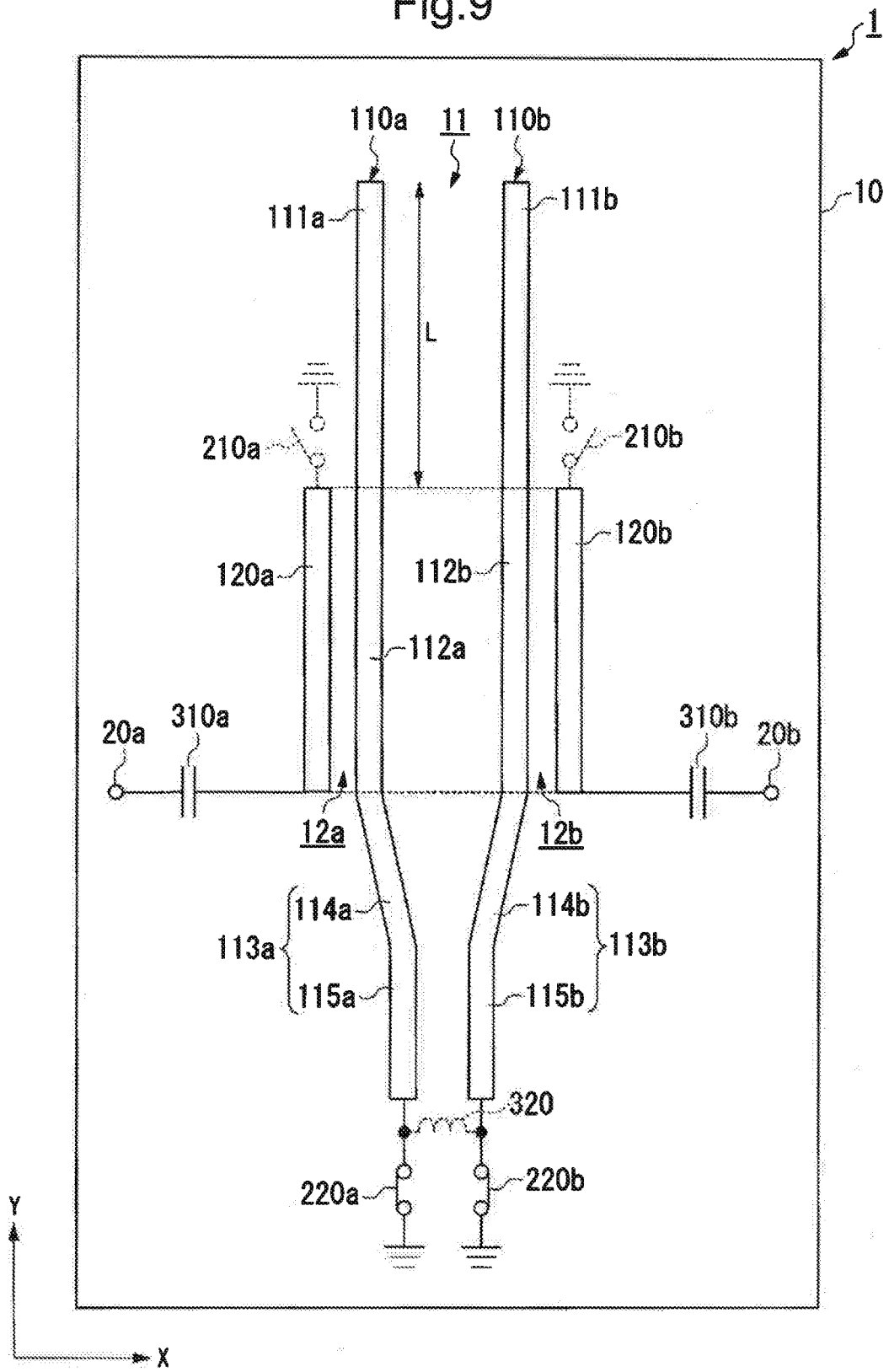
FIG. 9 is a diagram illustrating a circuit configuration when the filter circuit according to the first example embodiment is made to function as a filter that passes a third frequency.

FIG. 9 is a diagram illustrating a circuit configuration when the filter circuit according to the first example embodiment is made to function as a filter that passes a third frequency.

When the filter circuit 1 is made to function as a filter that passes a first frequency, the first switch 210*a* and the second switch 210*b* are opened, and the third switch 220*a* and the fourth switch 220*b* are closed.

When an electrical signal is applied to the input terminal 20*a*, a direct current component of the signal is cut off by the first capacitor 310*a*. A signal from which a direct current component is cut off flows into the first subordinate transmission line 120*a*. When the signal flows into the first subordinate transmission line 120*a*, the signal is transmitted, by electromagnetic coupling, to the first subordinate coupling part 112*a* that is electromagnetically coupled with the first subordinate transmission line 120*a*. At this time, the first switch 210*a* is opened, unlike in a case of making the filter circuit 1 function as a filter that passes a first frequency. Thus, a degree of matching with respect to the first frequency decreases, and a transmission property of the first frequency is suppressed. On the other hand, since the first switch 210*a* is opened, a degree of matching with respect to the third frequency increases, and a transmission property of the third frequency is enhanced. In other words, the first open stub 111*a* has such an electrical length that decreases the degree of matching with respect to the first frequency when the first switch 210*a* is opened, and that decreases the degree of matching with respect to the third frequency when the first switch 210*a* is closed.

Since the third switch 220*a* and the fourth switch 220*b* are closed, the main coupling line 11 including the first subordinate coupling part 112*a* functions as a one-side-open transmission line that has an electrical length being one quarter a wavelength corresponding to the first frequency. In other words, the main coupling line 11 functions as a bandpass filter that passes an odd-times higher harmonic having the first frequency. Note that the main coupling line 11 functions as a bandpass filter that passes the third frequency, since a transmission property of a first-frequency signal in the first subordinate coupling line 12*a* is small, as described above.

Upon transmission of a signal to the main coupling line 11, the signal is transmitted to the second subordinate transmission line 120*b* that is electromagnetically coupled with the second subordinate coupling part 112*b*. Accordingly, a third-frequency signal out of input signals is output from the output terminal 20*b* connected with the second subordinate transmission line 120*b*.

Figure 10:
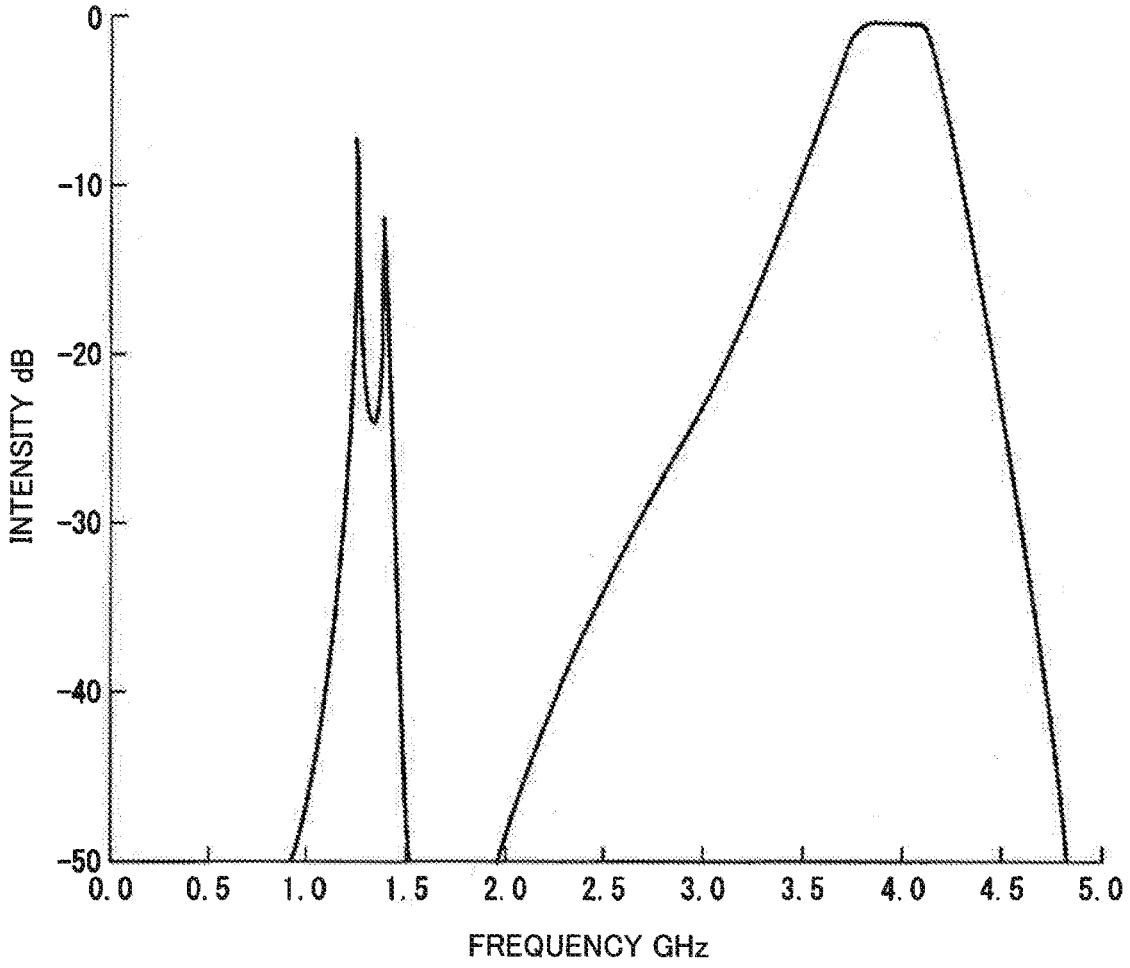
FIG. 10 is a diagram illustrating an intensity of a frequency component included in an output signal, when the filter circuit according to the first example embodiment is made to function as a filter that passes a third frequency.

FIG. 10 is a diagram illustrating an intensity of a frequency component included in an output signal, when the filter circuit according to the first example embodiment is made to function as a filter that passes a third frequency.

As illustrated in FIG. 10, the filter circuit 1 suppresses a first-frequency component included in an output signal, and passes a third-frequency component.

In this way, the present example embodiment enables the filter circuit 1 to function as a filter that passes a third frequency, by opening the first switch 210*a* and the second switch 210*b*, and closing the third switch 220*a* and the fourth switch 220*b*.

As described above, the present example embodiment is able to selectively switch a center frequency of a passband of the filter circuit 1 among a first frequency, a second frequency, and a third frequency, by switching opening and grounding of the first main transmission line 110*a* and the second main transmission line 110*b*, and the first subordinate transmission line 120*a* and the second subordinate transmission line 120*b*.

Specifically, the present example embodiment is able to selectively switch a center frequency of a passband of the filter circuit 1 between a first frequency and a third frequency, by switching opening and grounding of the first-side ends in the Y-axis direction of the first subordinate transmission line 120*a* and the second subordinate transmission line 120*b* when the second-side ends in the Y-axis direction of the first main transmission line 110*a* and the second main transmission line 110*b* are grounded.

In addition, the present example embodiment is able to selectively switch a center frequency of a passband of the filter circuit 1 between a second frequency and a third frequency, by switching opening and grounding of the second-side ends in the Y-axis direction of the first main transmission line 110*a* and the second main transmission line 110*b* when the first-side ends in the Y-axis direction of the first subordinate transmission line 120*a* and the second subordinate transmission line 120*b* are opened.

Second Example Embodiment

Figure 11:
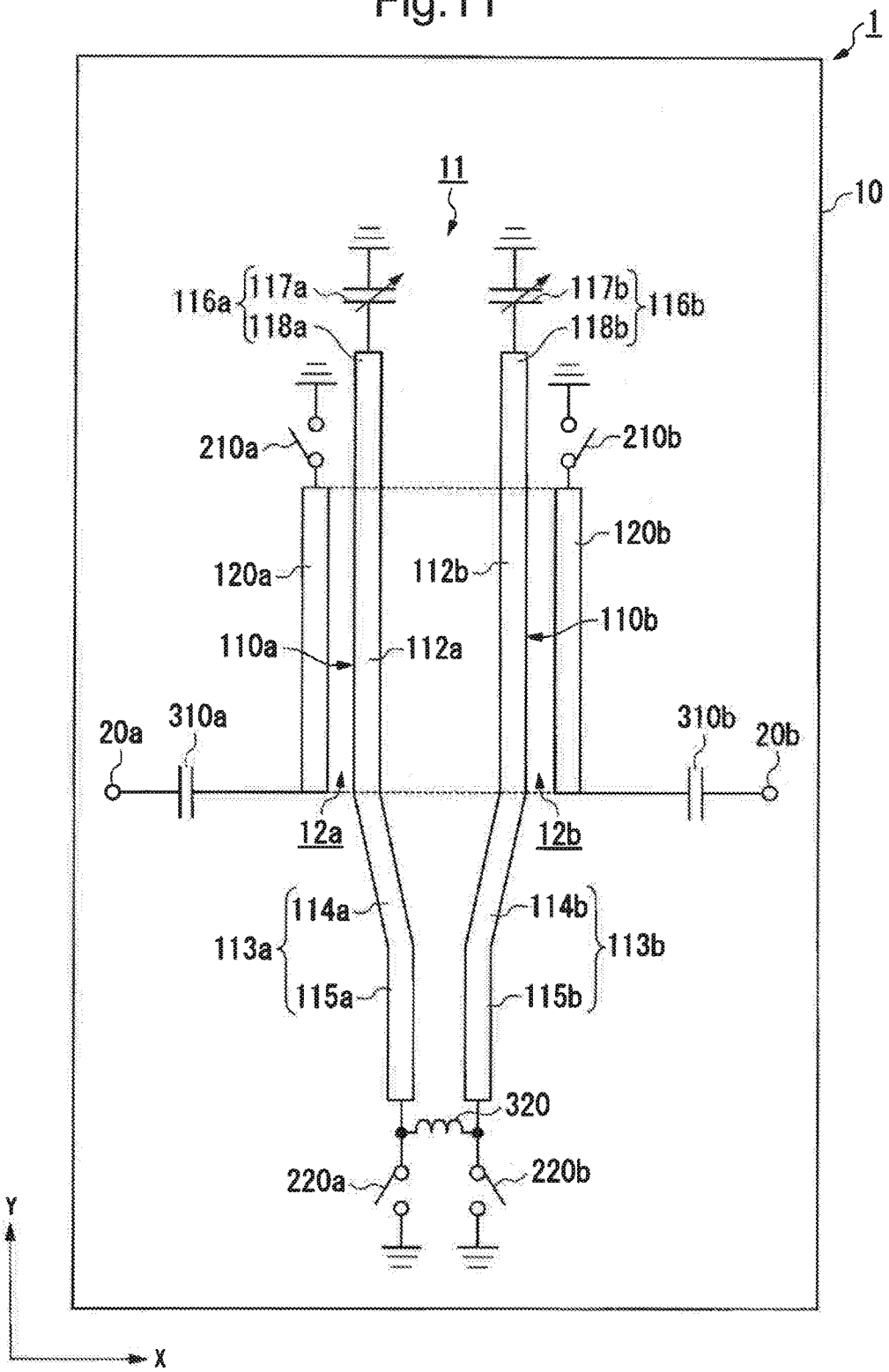
FIG. 11 is a diagram illustrating a configuration of a filter circuit according to a second example embodiment.

FIG. 11 is a diagram illustrating a configuration of a filter circuit according to a second example embodiment.

A first main transmission line 110*a* and a second main transmission line 110*b* in a filter circuit 1 according to the second example embodiment have configurations different from those in the filter circuit 1 according to the first example embodiment. Specifically, the first main transmission line 110*a* according to the second example embodiment includes a first open end part 116*a*, instead of the first open stub 111*a*. The first open end part 116*a* is composed of a first variable capacitor 117*a* and a first open end-side connecting line 118*a*, in order from a first side in a Y-axis direction. The first variable capacitor 117*a* has a first-side end part in the Y-axis direction connected with ground, and has a second-side end part in the Y-axis direction connected with the first open end-side connecting line 118*a*. The first open end part 116*a* behaves as a circuit equivalent to the first open stub 111*a*.

Likewise, the second main transmission line 110*b* according to the second example embodiment includes, instead of the second open stub 111*b*, a second open end part 116*b* that is composed of a second variable capacitor 117*b* and a second open end-side connecting line 118*b*. The second open end part 116*b* behaves as a circuit equivalent to the second open stub 111*b*.

The filter circuit 1 according to the second example embodiment is able to vary an electrical length of the first open end part 116*a* and the second open end part 116*b* (in other words, an electrical length of the first main transmission line 110*a* and the second main transmission line 110*b*), by varying a capacitance of the first variable capacitor 117*a* and the second variable capacitor 117*b*. In other words, in the second example embodiment, a second frequency is not necessarily limited to a frequency being twice a first frequency. In addition, in the second example embodiment, a third frequency is not necessarily limited to a frequency being three times the first frequency. However, a wavelength equivalent to the first frequency is longer than a wavelength equivalent to the second frequency, and the wavelength equivalent to the second frequency is longer than a wavelength equivalent to the third frequency.

Figure 12:
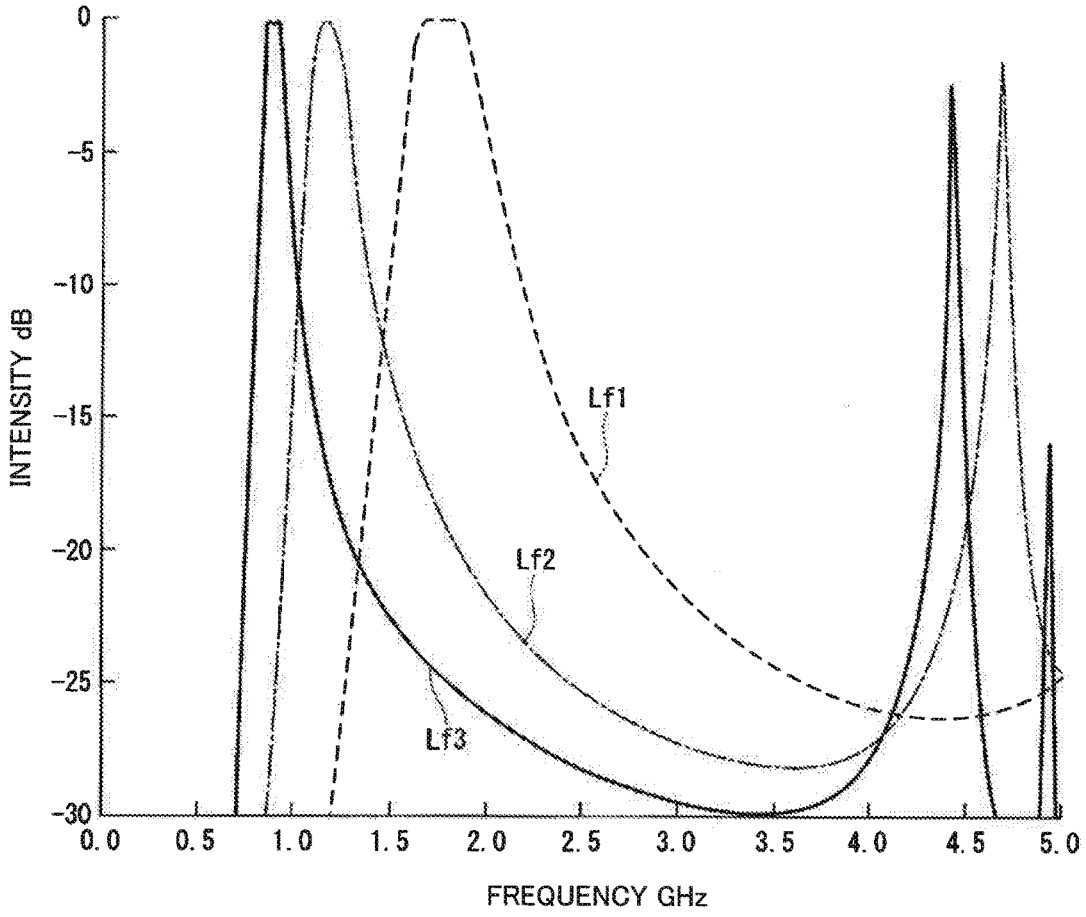
FIG. 12 is a diagram illustrating a relationship between a capacitance of a variable capacitor and a frequency component included in an output signal, when the filter circuit according to the second example embodiment is made to function as a filter that passes a first frequency.

FIG. 12 is a diagram illustrating a relationship between a capacitance of a variable capacitor and a frequency component included in an output signal, when the filter circuit according to the second example embodiment is made to function as a filter that passes a first frequency. In FIG. 12, a line Lf1 indicates a case in which the first variable capacitor 117*a* and the second variable capacitor 117*b* have a capacitance of 0.5 pF. A line Lf2 indicates a case in which the capacitance is 2.5 pF. A line Lf3 indicates a case in which the capacitance is 5 pF. A case will be described in which a first switch 210*a* and a second switch 210*b*, and a third switch 220*a* and a fourth switch 220*b* in the filter circuit 1 according to the second example embodiment are closed. In this case, by varying the capacitance of the first variable capacitor 117*a* and the second variable capacitor 117*b*, a center frequency of a passband can be varied as illustrated in FIG. 12.

In a certain experimental example, when it is assumed that the first variable capacitor 117*a* and the second variable capacitor 117*b* have a capacitance of 0.5 pF, a center frequency of a passband of the filter circuit 1 becomes 870 MHz. In addition, when it is assumed that the first variable capacitor 117*a* and the second variable capacitor 117*b* have a capacitance of 2.5 pF, a center frequency of a passband of the filter circuit 1 becomes 1.16 GHz. In addition, when it is assumed that the first variable capacitor 117*a* and the second variable capacitor 117*b* have a capacitance of 5.0 pF, a center frequency of a passband of the filter circuit 1 becomes 1.76 GHz.

In this way, the filter circuit 1 according to the present example embodiment is able to select a frequency from an 800 MHz band to a 1.7 GHz band as a first frequency.

Figure 13:
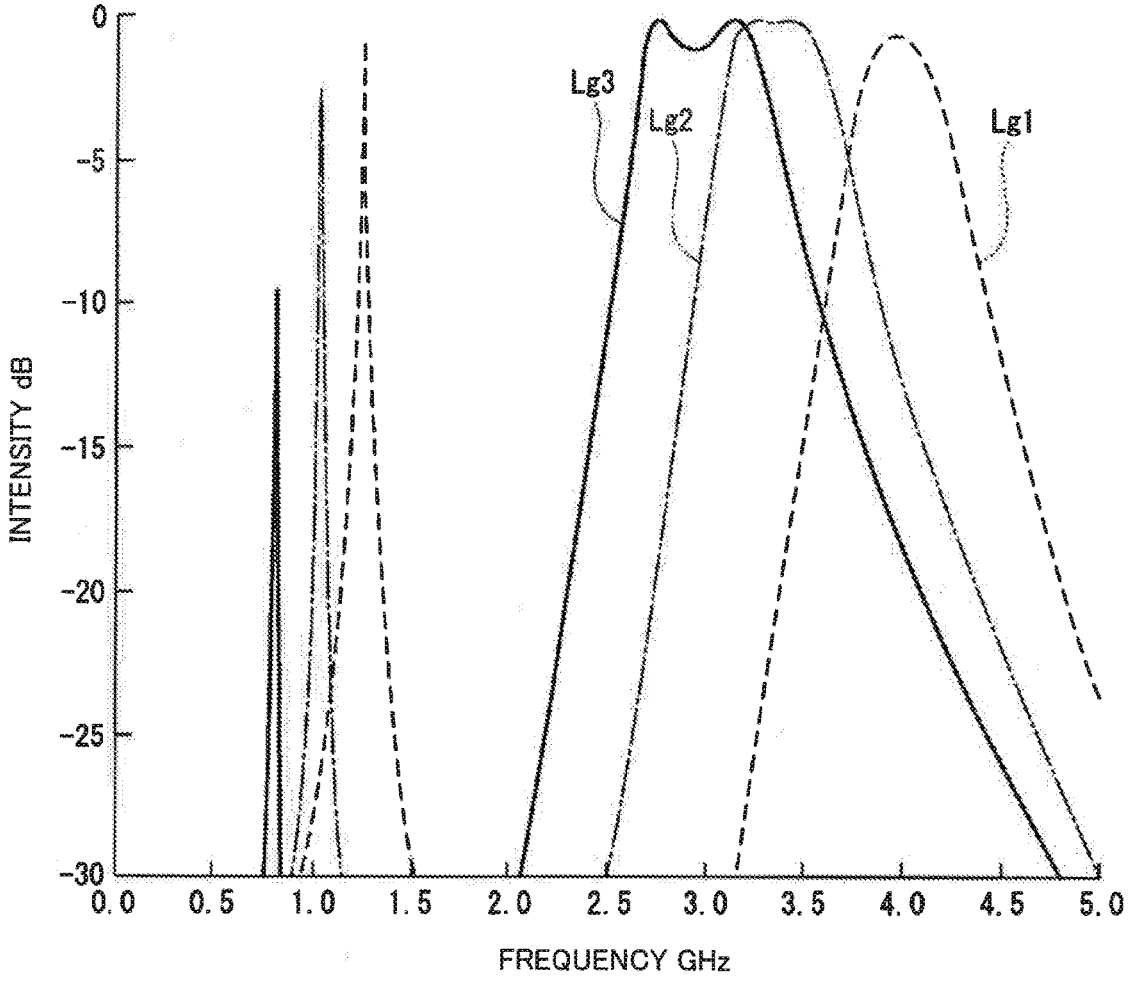
FIG. 13 is a diagram illustrating a relationship between a capacitance of a variable capacitor and a frequency component included in an output signal, when the filter circuit according to the second example embodiment is made to function as a filter that passes a second frequency.

FIG. 13 is a diagram illustrating a relationship between a capacitance of a variable capacitor and a frequency component included in an output signal, when the filter circuit according to the second example embodiment is made to function as a filter that passes a second frequency. In FIG. 13, a line Lg1 indicates a case in which the first variable capacitor 117*a* and the second variable capacitor 117*b* have a capacitance of 0.5 pF. A line Lg2 indicates a case in which the capacitance is 1.5 pF. A line Lg3 indicates a case in which the capacitance is 3.5 pF. A case will be described in which the first switch 210*a* and the second switch 210*b*, and the third switch 220*a* and the fourth switch 220*b* in the filter circuit 1 according to the second example embodiment are opened. In this case, by varying the capacitance of the first variable capacitor 117*a* and the second variable capacitor 117*b*, a center frequency of a passband can be varied as illustrated in FIG. 13.

In a certain experimental example, when it is assumed that the first variable capacitor 117*a* and the second variable capacitor 117*b* have a capacitance of 0.5 pF, a center frequency of a passband of the filter circuit 1 becomes 2.95 GHz. In addition, when it is assumed that the first variable capacitor 117*a* and the second variable capacitor 117*b* have a capacitance of 1.5 pF, a center frequency of a passband of the filter circuit 1 becomes 3.35 GHz. In addition, when it is assumed that the first variable capacitor 117*a* and the second variable capacitor 117*b* have a capacitance of 3.5 pF, a center frequency of a passband of the filter circuit 1 becomes 3.98 GHz.

In this way, the filter circuit 1 according to the present example embodiment is able to select a frequency from a 2.9 GHz band to a 4.0 GHz band as a second frequency.

Figure 14:
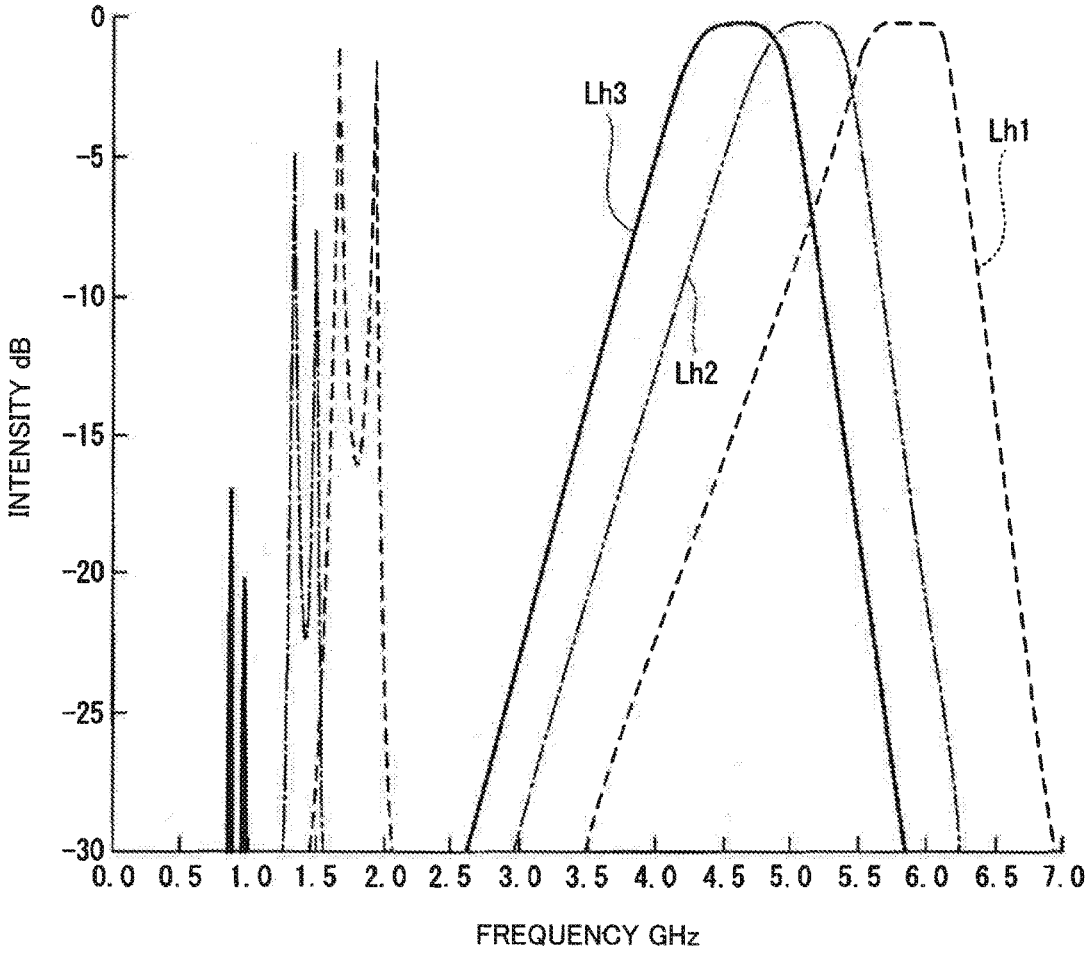
FIG. 14 is a diagram illustrating a relationship between a capacitance of a variable capacitor and a frequency component included in an output signal, when the filter circuit according to the second example embodiment is made to function as a filter that passes a third frequency.

FIG. 14 is a diagram illustrating a relationship between a capacitance of a variable capacitor and a frequency component included in an output signal, when the filter circuit according to the second example embodiment is made to function as a filter that passes a third frequency. In FIG. 14, a line Lh1 indicates a case in which the first variable capacitor 117*a* and the second variable capacitor 117*b* have a capacitance of 0.5 pF. A line Lh2 indicates a case in which the capacitance is 1.5 pF. A line Lh3 indicates a case in which the capacitance is 5 pF. A case will be described in which the first switch 210*a* and the second switch 210*b* in the filter circuit 1 according to the second example embodiment are opened, and the third switch 220*a* and the fourth switch 220*b* are closed. In this case, by varying the capacitance of the first variable capacitor 117*a* and the second variable capacitor 117*b*, a center frequency of a passband can be varied as illustrated in FIG. 14.

In a certain experimental example, when it is assumed that the first variable capacitor 117*a* and the second variable capacitor 117*b* have a capacitance of 0.5 pF, a center frequency of a passband of the filter circuit 1 becomes 4.63 GHz. In addition, when it is assumed that the first variable capacitor 117*a* and the second variable capacitor 117*b* have a capacitance of 1.5 pF, a center frequency of a passband of the filter circuit 1 becomes 5.15 GHz. In addition, when it is assumed that the first variable capacitor 117*a* and the second variable capacitor 117*b* have a capacitance of 5.0 pF, a center frequency of a passband of the filter circuit 1 becomes 5.89 GHz.

In this way, the filter circuit 1 according to the present example embodiment is able to select a frequency from a 4 GHz band to a 6 GHz band as a third frequency.

As described above, the filter circuit 1 according to the second example embodiment is able to pass a signal having an arbitrary frequency from a 800 MHz band to a 6 GHz band, by opening and closing of the first main transmission line 110*a*, the second main transmission line 110*b*, the first subordinate transmission line 120*a*, and the second subordinate transmission line 120*b*, and by control of the capacitance of the first variable capacitor 117*a* and the second variable capacitor 117*b*.

In the second example embodiment, the first open end part 116*a* is composed of the first variable capacitor 117*a* and the first open end-side connecting line 118*a*, and the second open end part 116*b* is composed of the second variable capacitor 117*b* and the second open end-side connecting line 118*b*. However, the example embodiments according to the present invention are not limited thereto. For example, in another example embodiment, the first open end part 116*a* may have a configuration composed only of the first variable capacitor 117*a*, and the second open end part 116*b* may have a configuration composed only of the second variable capacitor 117*b*. In addition, in still another example embodiment, each of the first open end part 116*a* and the second open end part 116*b* may include a fixed capacitor, instead of the first variable capacitor 117*a* and the second variable capacitor 117*b*.

As above, a plurality of example embodiments have been described in detail with reference to the drawings. However, various design modifications and the like can be made to a specific configuration, without limitation to the above-described example embodiments.

For example, in the above-described example embodiments, each transmission line has a shape extending in a linear shape. However, the example embodiments of the present invention are not limited thereto. For example, each transmission line according to another example embodiment may have a shape partially having a bent part, such as a hairpin shape.

In the above-described example embodiments, the input terminal 20*a* and the first capacitor 310*a* are connected with the second-side end in the Y-axis direction of the first subordinate transmission line 120*a*, and the output terminal 20*b* and the second capacitor 310*b* are connected with the second-side end in the Y-axis direction of the second subordinate transmission line 120*b*. However, the example embodiments of the present invention are not limited thereto. For example, in another example embodiment, the input terminal 20*a* and the first capacitor 310*a* may be connected with the first-side end in the Y-axis direction of the first subordinate transmission line 120*a*, and the output terminal 20*b* and the second capacitor 310*b* may be connected with the first-side end in the Y-axis direction of the second subordinate transmission line 120*b*. In addition, in still another example embodiment, the filter circuit 1 may not include the first capacitor 310*a* and the second capacitor 310*b* when a direct current component has sufficiently small influence.

<<First Basic Configuration>>

Figure 15:
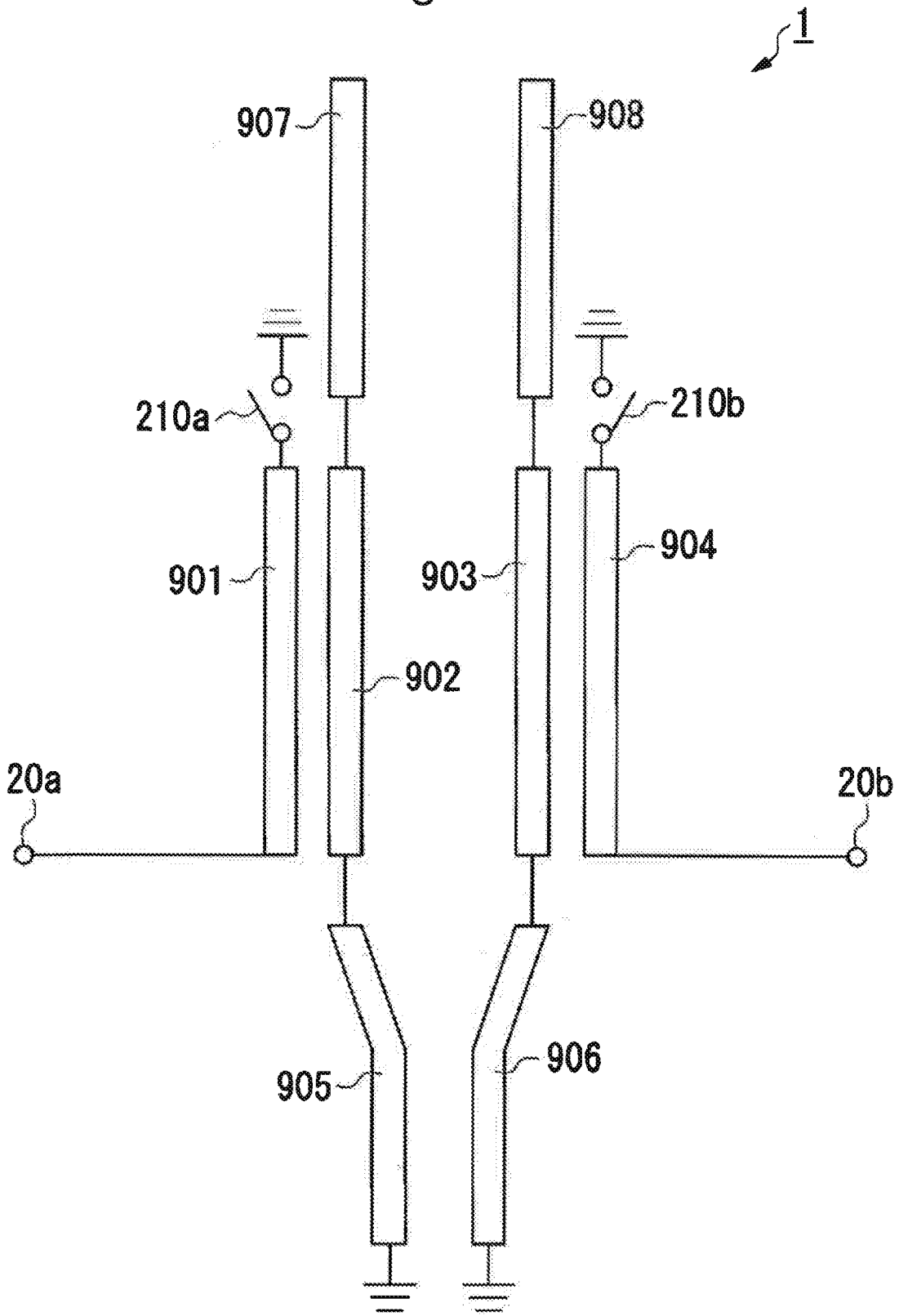
FIG. 15 is a schematic block diagram illustrating a first basic configuration of a filter circuit according to an example embodiment.

FIG. 15 is a schematic block diagram illustrating a first basic configuration of a filter circuit.

In the above-described example embodiments, the configurations illustrated in FIGS. 1 and 11 have been described as example embodiments of a filter circuit. One of the basic configurations of a filter circuit is as illustrated in FIG. 15.

In other words, a basic configuration of a filter circuit 1 is a configuration that includes a first transmission line 901, a second transmission line 902, a fourth transmission line 903, a third transmission line 904, a fifth transmission line 905, a sixth transmission line 906, an input terminal 20*a*, an output terminal 20*b*, a first open end part 907, a second open end part 908, a first switch 210*a*, and a second switch 210*b*.

The first transmission line 901 and the second transmission line 902 are provided in such a way that an electrical length becomes one quarter a first wavelength, and are provided in such a way as to face each other with a space therebetween. The input terminal 20*a* is connected with an end part in an electrical flow direction of the first transmission line 901. The fourth transmission line 903 and the third transmission line 904 are provided in such a way that an electrical length becomes one quarter the first wavelength, and are provided in such a way as to face each other with a space therebetween. The output terminal 20*b* is connected with an end part in an electrical flow direction of the third transmission line 904. The first open end part 907 is connected with a position of the second transmission line 902, opposing a first-side end part in the electrical flow direction of the first transmission line 901, and has a predetermined electrical length. The second open end part 908 is connected with a position of the fourth transmission line 903, opposing a first-side end part in the electrical flow direction of the third transmission line 904, and has a predetermined electrical length. The fifth transmission line 905 is connected with a position of the second transmission line 902, opposing a second-side end part in the electrical flow direction of the first transmission line 901. The sixth transmission line 906 is connected with a position of the fourth transmission line 903, opposing a second-side end part in the electrical flow direction of the third transmission line 904, and at least partially includes a portion facing the fifth transmission line 905 with a space therebetween. The first switch 210*a* is provided so as to be capable of opening and closing connection between the first-side end part in the electrical flow direction of the first transmission line 901 and ground. The second switch 210*b* is provided so as to be capable of opening and closing connection between the first-side end part in the electrical flow direction of the third transmission line 904 and ground. A transmission line composed of the first open end part 907, the second transmission line 902, and the fifth transmission line 905, and a transmission line composed of the second open end part 908, the fourth transmission line 903, and the sixth transmission line 906, are provided in such a way as to have an electrical length being one quarter a second wavelength that is a longer wavelength than the first wavelength. A first-side end part in an electrical flow direction of the fifth transmission line 905 and a first-side end part in an electrical flow direction of the sixth transmission line 906 are connected with ground.

With the above-described configuration, the filter circuit 1 is able to switch a center frequency into a frequency equivalent to the first wavelength and a frequency equivalent to the second wavelength, by opening and closing the first switch 210*a* and the second switch 210*b*.

The first subordinate transmission line 120*a* is an example of the first transmission line 901. The first subordinate coupling part 112*a* is an example of the second transmission line 902. The second subordinate coupling part 112*b* is an example of the fourth transmission line 903. The second subordinate transmission line 120*b* is an example of the third transmission line 904. The first main coupling part 113*a* is an example of the fifth transmission line 905. The second main coupling part 113*b* is an example of the sixth transmission line 906. Each of the first open stub 111*a* and the first open end part 116*a* is an example of the first open end part 907. Each of the second open stub 111*b* and the second open end part 116*b* is an example of the second open end part 908.

In other words, the first transmission line 901 has an electrical length being a one-quarter length of the first wavelength, in a direction (a longitudinal direction) in which electricity flows through the first transmission line 901. The first transmission line 901 includes a first end part and a second end part positioned on opposite sides to each other (an upstream side and a downstream side) with respect to the direction in which electricity flows through the first transmission line 901.

The second transmission line 902 has an electrical length being a one-quarter length of the first wavelength, in a direction (a longitudinal direction) in which electricity flows through the second transmission line 902. The second transmission line 902 is spaced apart from and faces the first transmission line 901. The second transmission line 902 includes a first opposing part opposing the first end part of the first transmission line 901 and a second opposing part opposing the second end part of the first transmission line 901.

The input terminal 20*a* is connected with the first end part or the second end part of the first transmission line 901.

The third transmission line 904 has an electrical length being a one-quarter length of the first wavelength, in a direction (a longitudinal direction) in which electricity flows through the third transmission line 904. The third transmission line 904 includes a first end part and a second end part positioned on opposite sides to each other (an upstream side and a downstream side) with respect to the direction in which electricity flows through the third transmission line 904.

The fourth transmission line 903 has an electrical length being a one-quarter length of the first wavelength, in a direction (a longitudinal direction) in which electricity flows through the fourth transmission line 903. The fourth transmission line 903 is spaced apart from and faces the third transmission line 904. The fourth transmission line 903 includes a first opposing part opposing the first end part of the third transmission line 904 and a second opposing part opposing the second end part of the third transmission line 904.

The output terminal 20*b* is connected with the first end part or the second end part of the third transmission line 904.

The first open end part 907 is connected with the first opposing part of the second transmission line 902, and has a predetermined electrical length in a direction (a longitudinal direction) in which electricity flows through the first open end part 907.

The second open end part 908 is connected with the first opposing part of the fourth transmission line 903, and has a predetermined electrical length in a direction (a longitudinal direction) in which electricity flows through the second open end part 908.

The fifth transmission line 905 includes a first end part and a second end part positioned on opposite sides to each other (an upstream side and a downstream side) with respect to a direction (a longitudinal direction) in which electricity flows through the fifth transmission line 905. The fifth transmission line 905 has the first end part of the fifth transmission line 905 being connected with the second opposing part of the second transmission line 902.

The sixth transmission line 906 includes a first end part and a second end part positioned on opposite sides to each other (an upstream side and a downstream side) with respect to a direction (a longitudinal direction) in which electricity flows through the sixth transmission line 906, and a portion that is spaced apart from and faces at least a part of the fifth transmission line 905. The first end part of the sixth transmission line 906 is connected with the second opposing part of the fourth transmission line 903.

The first switch 210*a* is configured to open and close connection between the first end part of the first transmission line 901 and ground.

The second switch 210*b* is configured to open and close connection between the first end part of the third transmission line 904 and ground.

Each of a transmission line composed of the first open end part 907, the second transmission line 902, and the fifth transmission line 905, and a transmission line composed of the second open end part 908, the third transmission line 903, and the sixth transmission line 906, has an electrical length being a one-quarter length of a second wavelength that is a longer wavelength than the first wavelength.

The second end part of the fifth transmission line 905 and the second end part of the sixth transmission line 906 are connected with ground.

<<Second Basic Configuration>>

Figure 16:
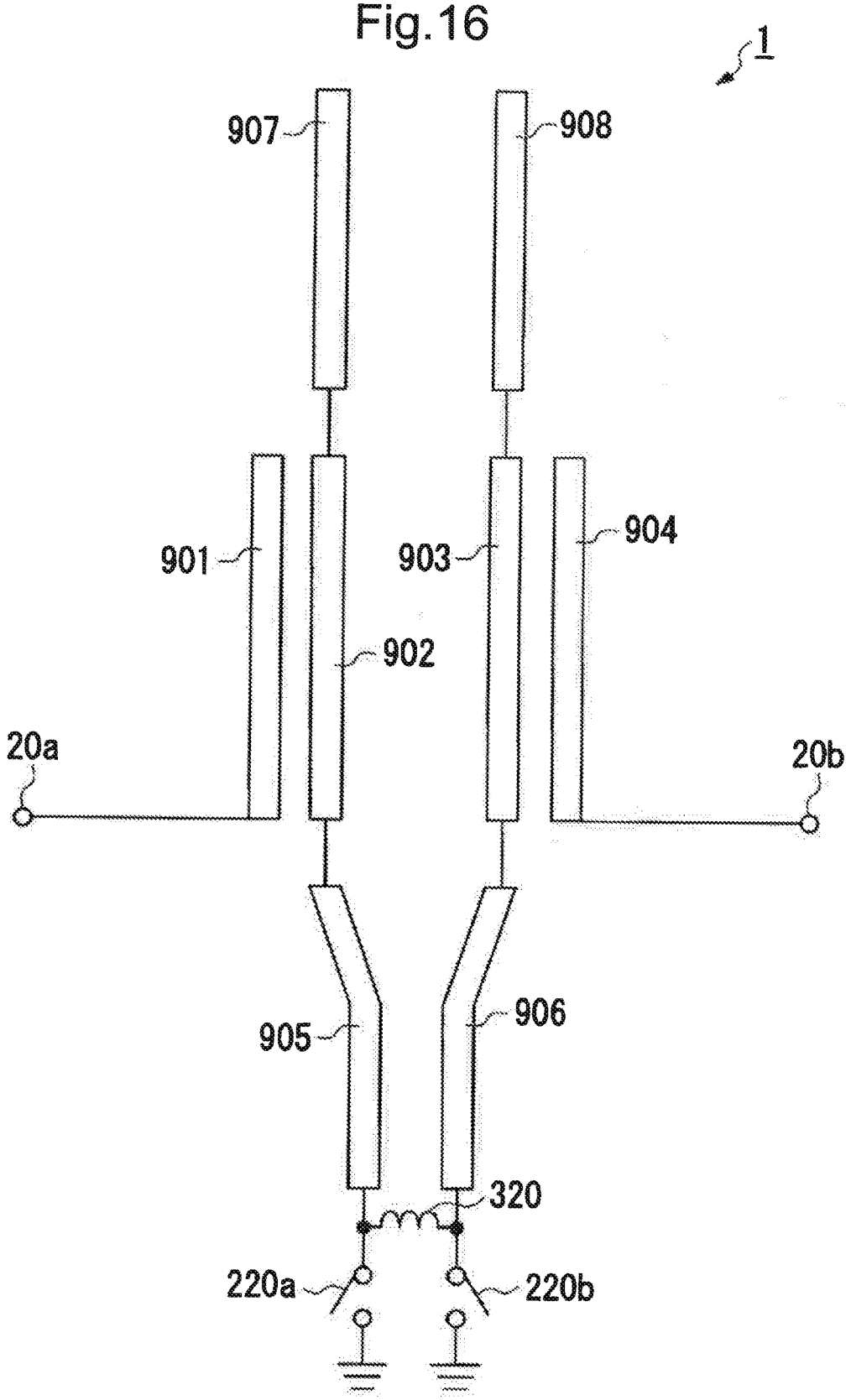
FIG. 16 is a schematic block diagram illustrating a second basic configuration of a filter circuit according to an example embodiment.

FIG. 16 is a schematic block diagram illustrating a second basic configuration of a filter circuit.

In the above-described example embodiments, the configurations illustrated in FIGS. 1 and 11 have been described as example embodiments of a filter circuit. One of the basic configurations of a filter circuit is as illustrated in FIG. 16.

In other words, a basic configuration of a filter circuit 1 is a configuration that includes a first transmission line 901, a second transmission line 902, a fourth transmission line 903, a third transmission line 904, a fifth transmission line 905, a sixth transmission line 906, an input terminal 20*a*, an output terminal 20*b*, a first open end part 907, a second open end part 908, a third switch 220*a*, a fourth switch 220*b*, and an inductor 320.

The first transmission line 901 and the second transmission line 902 are provided in such a way that an electrical length becomes one quarter a first wavelength, and are provided in such a way as to face each other with a space therebetween. The input terminal 20*a* is connected with an end part in an electrical flow direction of the first transmission line 901. The fourth transmission line 903 and the third transmission line 904 are provided in such a way that an electrical length becomes one quarter the first wavelength, and are provided in such a way as to face each other with a space therebetween. The output terminal 20*b* is connected with an end part in an electrical flow direction of the third transmission line 904. The first open end part 907 is connected with a position of the second transmission line 902, opposing a first-side end part in the electrical flow direction of the first transmission line 901, and has a predetermined electrical length. The second open end part 908 is connected with a position of the fourth transmission line 903, opposing a first-side end part in the electrical flow direction of the third transmission line 904, and has a predetermined electrical length. The fifth transmission line 905 is connected with a position of the second transmission line 902, opposing a second-side end part in the electrical flow direction of the first transmission line 901. The sixth transmission line 906 is connected with a position of the fourth transmission line 903, opposing a second-side end part in the electrical flow direction of the third transmission line 904, and at least partially includes a portion facing the fifth transmission line 905 with a space therebetween. The inductor 320 is connected between a second-side end part in an electrical flow direction of the fifth transmission line 905 and a second-side end part in an electrical flow direction of the sixth transmission line 906. The third switch 220*a* is provided so as to be capable of opening and closing connection between the second-side end part in the electrical flow direction of the fifth transmission line 905 and ground. The fourth switch 220*b* is provided so as to be capable of opening and closing connection between the second-side end part in the electrical flow direction of the sixth transmission line 906 and ground. A transmission line composed of the first open end part 907, the second transmission line 902, and the fifth transmission line 905, and a transmission line composed of the second open end part 908, the fourth transmission line 903, and the sixth transmission line 906, are provided in such a way as to have an electrical length being one quarter a second wavelength that is a longer wavelength than the first wavelength. The first-side end part in the electrical flow direction of the first transmission line 901 and the first-side end part in the electrical flow direction of the third transmission line 904 are opened.

With the above-described configuration, the filter circuit 1 is able to switch a center frequency into a frequency equivalent to the first wavelength and a frequency equivalent to a third wavelength, by opening and closing the third switch 220*a* and the fourth switch 220*b*. Note that the third wavelength is a wavelength that is longer than the first wavelength but is shorter than the second wavelength.

In other words, the first transmission line 901 has an electrical length being a one-quarter length of the first wavelength, in a direction (a longitudinal direction) in which electricity flows through the first transmission line 901. The first transmission line 901 includes a first end part and a second end part positioned on opposite sides to each other (an upstream side and a downstream side) with respect to the direction in which electricity flows through the first transmission line 901.

The second transmission line 902 has an electrical length being a one-quarter length of the first wavelength, in a direction (a longitudinal direction) in which electricity flows through the second transmission line 902. The second transmission line 902 is spaced apart from and faces the first transmission line 901. The second transmission line 902 includes a first opposing part opposing the first end part of the first transmission line 901 and a second opposing part opposing the second end part of the first transmission line 901.

The input terminal 20*a* is connected with the first end part or the second end part of the first transmission line 901.

The third transmission line 904 has an electrical length being a one-quarter length of the first wavelength, in a direction (a longitudinal direction) in which electricity flows through the third transmission line 904. The third transmission line 904 includes a first end part and a second end part positioned on opposite sides to each other (an upstream side and a downstream side) with respect to the direction in which electricity flows through the third transmission line 904.

The fourth transmission line 903 has an electrical length being a one-quarter length of the first wavelength, in a direction (a longitudinal direction) in which electricity flows through the fourth transmission line 903. The fourth transmission line 903 is spaced apart from and faces the third transmission line 904. The fourth transmission line 903 includes a first opposing part opposing the first end part of the third transmission line 904 and a second opposing part opposing the second end part of the third transmission line 904.

The output terminal 20*b* is connected with the first end part or the second end part of the third transmission line 904.

The first open end part 907 is connected with the first opposing part of the second transmission line 902, and has a predetermined electrical length in a direction (a longitudinal direction) in which electricity flows through the first open end part 907.

The second open end part 908 is connected with the first opposing part of the fourth transmission line 903, and has a predetermined electrical length in a direction (a longitudinal direction) in which electricity flows through the second open end part 908.

The fifth transmission line 905 includes a first end part and a second end part positioned on opposite sides to each other (an upstream side and a downstream side) with respect to a direction (a longitudinal direction) in which electricity flows through the fifth transmission line 905. The fifth transmission line 905 has the first end part of the fifth transmission line 905 being connected with the second opposing part of the second transmission line 902.

The sixth transmission line 906 includes a first end part and a second end part positioned on opposite sides to each other (an upstream side and a downstream side) with respect to a direction (a longitudinal direction) in which electricity flows through the sixth transmission line 906, and a portion that is spaced apart from and faces at least a part of the fifth transmission line 905. The first end part of the sixth transmission line 906 is connected with the second opposing part of the fourth transmission line 903.

The third switch 220*a* is configured to open and close connection between the second end part of the fifth transmission line 905 and ground.

The fourth switch 220*b* is configured to open and close connection between the second end part of the sixth transmission line 906 and ground.

Each of a transmission line composed of the first open end part 907, the second transmission line 902, and the fifth transmission line 905, and a transmission line composed of the second open end part 908, the fourth transmission line 903, and the sixth transmission line 906, has an electrical length being a one-quarter length of a second wavelength that is a longer wavelength than the first wavelength.

The first end part of the first transmission line and the first end part of the third transmission line are opened.

This application is based upon and claims the benefit of priority from Japanese Patent Application No. 2015-081751, filed on Apr. 13, 2015, the disclosure of which is incorporated herein in its entirety.

INDUSTRIAL APPLICABILITY

The present invention may be applied to a filter circuit and a frequency switching method.

REFERENCE SIGNS LIST

1 Filter circuit
20*a* Input terminal
20*b* Output terminal
110*a* First main transmission line
110*b* Second main transmission line
120*a* First subordinate transmission line
120*b* Second subordinate transmission line
210*a* First switch
210*b* Second switch
220*a* Third switch
220*b* Fourth switch

The invention claimed is:

1. A filter circuit comprising:

a first transmission line that has an electrical length being a one-quarter length of a first wavelength, and includes a first end part and a second end part positioned on opposite sides to each other with respect to a direction in which electricity flows through the first transmission line;

a second transmission line that has an electrical length being a one-quarter length of the first wavelength, is spaced apart from and faces the first transmission line, and includes a first opposing part opposing the first end part of the first transmission line and a second opposing part opposing the second end part of the first transmission line;

an input terminal that is connected with the first end part or the second end part of the first transmission line;

a third transmission line that has an electrical length being a one-quarter length of the first wavelength, and includes a first end part and a second end part positioned on opposite sides to each other with respect to a direction in which electricity flows through the third transmission line;

a fourth transmission line that has an electrical length being a one-quarter length of the first wavelength, is spaced apart from and faces the third transmission line, and includes a first opposing part opposing the first end part of the third transmission line and a second opposing part opposing the second end part of the third transmission line;

an output terminal that is connected with the first end part or the second end part of the third transmission line;

a first open end part that is connected with the first opposing part of the second transmission line, and has a predetermined electrical length;

a second open end part that is connected with the first opposing part of the fourth transmission line, and has a predetermined electrical length;

a fifth transmission line that includes a first end part and a second end part positioned on opposite sides to each other with respect to a direction in which electricity flows through the fifth transmission line, the first end part of the fifth transmission line being connected with the second opposing part of the second transmission line;

a sixth transmission line that includes a first end part and a second end part positioned on opposite sides to each other with respect to a direction in which electricity flows through the sixth transmission line, and a portion that is spaced apart from and faces at least a part of the fifth transmission line, the first end part of the sixth transmission line being connected with the second opposing part of the fourth transmission line;

a first switch that is configured to open and close connection between the first end part of the first transmission line and ground; and a second switch that is configured to open and close connection between the first end part of the third transmission line and ground, wherein each of a transmission line composed of the first open end part, the second transmission line, and the fifth transmission line, and a transmission line composed of the second open end part, the fourth transmission line, and the sixth transmission line, has an electrical length being a one-quarter length of a second wavelength that is a longer wavelength than the first wavelength, and the second end part of the fifth transmission line and the second end part of the sixth transmission line are connected with ground.

2. The filter circuit according to claim 1, wherein at least one of the first open end part and the second open end part has a capacitor connected with ground.

3. The filter circuit according to claim 2, wherein the capacitor is a variable capacitor.

4. The filter circuit according to claim 1, wherein the second wavelength is a wavelength being three times the first wavelength.

5. The filter circuit according to claim 4, wherein the first open end part and the second open end part have an electrical length being a one-quarter length of the first wavelength.

6. The filter circuit according to claim 4, wherein at least one of the first open end part and the second open end part has a capacitor connected with ground.

7. The filter circuit according to claim 1, wherein the first open end part and the second open end part have an electrical length being a one-quarter length of the first wavelength.

8. The filter circuit according to claim 7, wherein at least one of the first open end part and the second open end part has a capacitor connected with ground.

9. A frequency switching method for the filter circuit according to claim 1, comprising:

opening the first switch and the second switch, and closing the first switch and the second switch.

10. A filter circuit comprising:

a first transmission line that has an electrical length being a one-quarter length of a first wavelength, and includes a first end part and a second end part positioned on opposite sides to each other with respect to a direction in which electricity flows through the first transmission line;

a second transmission line that has an electrical length being a one-quarter length of the first wavelength, is spaced apart from and faces the first transmission line, and includes a first opposing part opposing the first end part of the first transmission line and a second opposing part opposing the second end part of the first transmission line;

an input terminal that is connected with the first end part or the second end part of the first transmission line;

a third transmission line that has an electrical length being a one-quarter length of the first wavelength, and includes a first end part and a second end part positioned on opposite sides to each other with respect to a direction in which electricity flows through the third transmission line;

a fourth transmission line that has an electrical length being a one-quarter length of the first wavelength, is spaced apart from and faces the third transmission line, and includes a first opposing part opposing the first end part of the third transmission line and a second opposing part opposing the second end part of the third transmission line;

an output terminal that is connected with the first end part or the second end part of the third transmission line;

a first open end part that is connected with the first opposing part of the second transmission line, and has a predetermined electrical length;

a second open end part that is connected with the first opposing part of the fourth transmission line, and has a predetermined electrical length;

a fifth transmission line that includes a first end part and a second end part positioned on opposite sides to each other with respect to a direction in which electricity flows through the fifth transmission line, the first end part of the fifth transmission line being connected with the second opposing part of the second transmission line;

a sixth transmission line that includes a first end part and a second end part positioned on opposite sides to each other with respect to a direction in which electricity flows through the sixth transmission line, and a portion that is spaced apart from and faces at least a part of the fifth transmission line, the first end part of the sixth transmission line being connected with the second opposing part of the fourth transmission line;

an inductor that is connected between the second end part of the fifth transmission line and the second end part of the sixth transmission line;

a third switch that is configured to open and close connection between the second end part of the fifth transmission line and ground; and a fourth switch that is configured to open and close connection between the second end part of the sixth transmission line and ground, wherein each of a transmission line composed of the first open end part, the second transmission line, and the fifth transmission line, and a transmission line composed of the second open end part, the fourth transmission line, and the sixth transmission line, has an electrical length being a one-quarter length of a second wavelength that is a longer wavelength than the first wavelength, and the first end part of the first transmission line and the first end part of the third transmission line are opened.

11. The filter circuit according to claim 10, wherein the first open end part and the second open end part have an electrical length being a one-quarter length of the first wavelength.

12. The filter circuit according to claim 10, further comprising:

a first switch that is configured to open and close connection between the first end part of the first transmission line and ground; and a second switch that is provided so as to be capable of opening and closing connection between the first end part of the third transmission line and ground.

13. The filter circuit according to claim 12, wherein the second wavelength is a wavelength being three times the first wavelength.

14. The filter circuit according to claim 12, wherein the first open end part and the second open end part have an electrical length being a one-quarter length of the first wavelength.

15. The filter circuit according to claim 12, wherein at least one of the first open end part and the second open end part has a capacitor connected with ground.

16. The filter circuit according to claim 10, wherein at least one of the first open end part and the second open end part has a capacitor connected with ground.

17. A frequency switching method for the filter circuit according to claim 10, comprising:

opening the third switch and the fourth switch, and closing the third switch and the fourth switch.

18. The filter circuit according to claim 10, wherein the second wavelength is a wavelength being three times the first wavelength.

19. The filter circuit according to claim 18, wherein the first open end part and the second open end part have an electrical length being a one-quarter length of the first wavelength.

20. The filter circuit according to claim 18, wherein at least one of the first open end part and the second open end part has a capacitor connected with ground.

* * * * *